US006911884B2

(12) United States Patent
Uotome et al.

(10) Patent No.: US 6,911,884 B2
(45) Date of Patent: Jun. 28, 2005

(54) ELECTROMAGNETIC SWITCHING APPARATUS

(75) Inventors: Riichi Uotome, Katano (JP); Hideki Enomoto, Ikoma (JP); Ritsu Yamamoto, Kyoutanabe (JP); Hideki Kishi, Matsusaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 29 days.

(21) Appl. No.: 10/432,347

(22) PCT Filed: Nov. 26, 2002

(86) PCT No.: PCT/JP02/12293

§ 371 (c)(1),
(2), (4) Date: May 29, 2003

(87) PCT Pub. No.: WO03/046940

PCT Pub. Date: Jun. 5, 2003

(65) Prior Publication Data

US 2004/0027776 A1 Feb. 12, 2004

(30) Foreign Application Priority Data

Nov. 29, 2001 (JP) ..... 2001-364329
Dec. 25, 2001 (JP) ..... 2001-392221

(51) Int. Cl.[7] ..... H01H 67/02
(52) U.S. Cl. ..... 335/132; 335/202
(58) Field of Search ..... 335/126, 131–132, 335/202; 200/298–305, 243

(56) References Cited

U.S. PATENT DOCUMENTS 4,893,102 A * 1/1990 Bauer ..... 335/132
5,394,128 A 2/1995 Perreira et al.
5,631,613 A 5/1997 Niimi et al.
5,892,194 A 4/1999 Uotome et al.
6,064,289 A * 5/2000 Wieloch et al. ..... 335/132
2004/0080389 A1 * 4/2004 Nishida et al. ..... 335/132

FOREIGN PATENT DOCUMENTS

JP 9-129107 5/1997
JP 9-259728 10/1997

* cited by examiner

*Primary Examiner*—Lincoln Donovan
(74) *Attorney, Agent, or Firm*—Greenblum & Bernstein, P.L.C.

(57) ABSTRACT

In an electromagnetic switching device including a cylindrical part made of a magnetic material with a closed bottom for housing a movable iron core having a movable contact and so constructed as to render the movable contact movable toward and away from a fixed contact, a joint member made of a metallic material with an insertion hole formed substantially in the center thereof for movably receiving a movable shaft fixedly attached to the movable iron core, and a metal plate made of a non-magnetic material with a hole formed substantially in the center thereof with the inner diameter substantially the same as the inner diameter of the cylindrical part, the cylindrical part and the joint member are air-tightly jointed to each other with the metal plate provided therebetween, and the movable iron core is housed in the cylindrical part with a clearance defined between the movable iron core and the joint member corresponding to a required stroke within which the movable contact contacts the fixed contact. This arrangement provides improvement in magnetic efficiency of electromagnet of the device. Accordingly, improved energy saving performance is accomplished as compared with a case of a conventional electromagnetic switching device.

23 Claims, 18 Drawing Sheets

ELECTROMAGNETIC SWITCHING APPARATUS

TECHNICAL FIELD

This invention relates to an electromagnetic switching device including a sealed contact device, which is suitable as a relay for power-driven load.

BACKGROUND ART

There has been proposed, as shown in FIG. 21, an electromagnetic switching device 1000 including a sealed contact device, which is disclosed in Japanese Patent No. 3107288 (corresponding to Japanese Unexamined Patent Publication No. 9-259728). The device 1000 is constructed such that a relay contact portion is housed in a hermetically sealed or air-tight space. With this arrangement, since there is no likelihood that arc generated in opening the contacts may leaked out of the device, this arrangement obviates a space for escaping arc which has been necessary in an air switching device, and makes it possible to mount parts in close contact with the device to raise the packaging density. The device 1000 is constructed as follows.

Referring to FIG. 21, the electromagnetic switching device 1000 comprises a sealed contact portion A, a driving section B, and a housing C. First, the sealed contact portion A is described. The sealed contact portion A comprises a box-like sealing vessel 1 which is made of a heat resisting material such as ceramics with an opening formed in one side thereof. The sealing vessel 1 is formed with two through holes 1*a*, 1*a* in the bottom surface thereof. Fixed terminals 2, 2, which are partially received in the through-holes 1*a*, 1*a*, each has a substantially multi-layered cylindrical shape made of e.g. a copper material with a closed bottom. A fixed contact 2*a* is fixedly connected to the closed bottom of the fixed terminal 2, and a flange portion 2*c* is formed at the axially other end of the fixed terminal 2. The other end of the fixed terminal 2 is opened. The fixed terminal 2 is air-tightly jointed to the sealing vessel 1 around the flange portion 2*c* by way of brazing or its equivalent in a state that the other end of the fixed terminal 2 protrudes from the sealing vessel 1. An axially-downwardly-oriented screw groove 2*b* is formed in the other end of the fixed terminal 2 in the open end.

A movable contact piece 3 has a planar shape made of e.g. a copper material. Movable contacts 3*a*, 3*a* are respectively fixedly attached at the longitudinal opposite ends of the movable contact piece 3 with a certain distance away from each other in such a manner that the movable contacts 3*a*, 3*a* are moved toward and away from the corresponding fixed contact 2*a*, 2*a*. An insertion hole 3*b* is formed in a central part of the movable contact piece 3. A substantially round bar-shaped movable shaft 4 has one end 4*a* thereof which is received in the insertion hole 3*b* and the other end 4*b* thereof which is formed with a screw groove 4*c*.

A contact piece holder 5 has a substantially U-shape in cross section and has a bottom wall 5*a* and a pair of side walls 5*b*, 5*b* opposing to each other. The contact piece holder 5 is adapted to hold a compression spring 6 in a compressed and suspended state therein in such a manner that the movable contact piece 3 is operatively linked to the movable shaft 4. A state as to how the compression spring 6 is compressed and suspended in the contact piece holder 5 is described. The bottom wall 5*a* is formed with an insertion hole 5*c* in a center thereof through which the one end 4*a* of the movable shaft 4 is received. The side wall 5*b* (5*b*) has an extension 5*d* (5*d*) which extends from the middle of a lateral end portion thereof in such a direction as to make the extensions 5*d*, 5*d* dose to each other. The extension 5*d* (5*d*) is formed with a downward extension (not shown) which extends from the distal end thereof downwardly toward the bottom wall 5*a*. The contact piece holder 5 is constructed such that the respective outer surfaces of the side walls 5*b*, 5*b* oppose to the respective inner surfaces of the sealing vessel 1. A pair of round protrusions 5*g*, 5*g* are formed at the outer surface of the side wall 5*b* (5*b*). Each protrusion 5*g* has a thickness substantially equal to the clearance defined by the outer surface of the side wall 5*b* and the opposing inner surface of the sealing vessel 1. The compression coil spring 6 is adapted to urge the movable contact piece 3 in such a direction as to render the movable contacts 3*a*, 3*a* in abuttal contact with the fixed contacts 2*a*, 2*a*. Thus, the compression spring 6 is retained in the contact piece holder 5.

A fixed iron core 7 has a generally cylindrical shape with one end 7*a* thereof having a larger diameter than that of the primary part thereof. An insertion hole 7*b* is axially formed in the fixed iron core 7 for receiving the movable shaft 4 therein. The fixed iron core 7 is fixedly connected with a first joint member 11 at the one end 7*a* by insertion of the fixed iron core 7 into a through-hole 11*a* of the first joint member 11. The fixed iron core 7 has a recess 7*c* at the other end thereof having the inner diameter larger than the inner diameter of the insertion hole 7*b*.

A generally cylindrical-shaped movable iron core 8 is formed with an axially extending insertion hole 8*a* through which the movable shaft 4 is inserted. The movable iron core 8 is formed with a screw grove 8*b* along the axial direction thereof to desirably shift the coupling position of the movable shaft 4 and the movable iron core 8 along the axial direction of the movable shaft 4 in cooperation with the screw groove 4*c* of the movable shaft 4. The movable iron core 8 has an opposing portion 8*c* at an axially end thereof opposing to the fixed iron core 7, and a recess 8*d* at the axially other end thereof having the inner diameter larger than the inner diameter of the screw groove 8*b*. The outer surface of the movable iron core 8 constitutes a sliding surface 8*e* which is rendered in sliding contact with the inner circumference of a cylindrical member 10 having a closed bottom, which will be described later.

A return spring 9 is adapted to urge the movable iron core 8 in such a direction as to move the movable contacts 3*a*, 3*a* away from the fixed contacts 2*a*, 2*a*. The return spring 9 is in the form of a coil and has the inner diameter slightly larger than the inner diameter of the insertion hole 7*b* of the fixed iron core 7. When the movable shaft 4 is inserted in the insertion hole 7*b* of the fixed iron core 7, and one end of the return spring 9 is fitted in the recess 7*c* of the fixed iron core 7, the return spring 9 is positioned relative to the recess 7*c*.

The cylindrical member 10 has a cylindrical shape made of a non-magnetic material with a closed bottom and includes a main part 10*a* and a bottom part 10*b*. The movable iron core 8 is housed in the bottom part 10*b*, while the fixed iron core 7 is housed in the cylindrical member 10 at the open end with the opposing portion 8*c* opposing the fixed iron core 7.

The first joint member 11 is made of a magnetic metal material such as iron and has a rectangular shape. The first joint member 11 constitutes a magnet circuit along with the fixed iron core 7 and the movable iron core 8. As mentioned above, the first joint member 11 is formed with the insertion hole 11*a* in the center thereof for receiving the one end 7*a* of the fixed iron core 7 prior to its fixation to the first joint member 11. The first joint member 11 is air-tightly connected with the cylindrical member 10 around the insertion hole 11*a*.

A second joint member 12 is made of a metallic material and has a cylindrical shape with a hollow 12*a* formed at the axially opposite ends thereof. The second joint member 12 has a first joint portion 12*c* at an axially one end thereof to be air-tightly connected with the open end of the sealing vessel 1, and a second joint portion 12*b* at the axially other end thereof to be air-tightly connected with the first joint member 11. The second joint member 12 is formed with a stepped portion 12*d* around its circumference at an appropriate position of the cylindrical part thereof. By forming the stepped portion 12*d*, the cross-section of the hollow 12*a* has a larger diameter at a portion between the first joint portion 12*c* and the second joint portion 12*b*. A sealed space 30 is defined by air-tightly connecting the second joint member 12, the sealing vessel 1, and the first joint member 11 each other to accommodate the fixed contacts 2*a*, 2*a*, the movable contacts 3*a*, 3*a*, the fixed iron core 7, and the movable iron core 8 therein. The sealed space 30 is hermetically sealed with hydrogen gas or gas containing hydrogen as a primary component of e.g. about 2 atmospheric pressure contained therein.

Next, the compressed and suspended state of the compression spring 6 is described. First, the movable contact piece 3 is fitted in the contact piece holder 5 in a state that the movable contacts 3*a*, 3*a* faces the insertion hole 5*c*. Next, the compression spring 6 is fitted in the contact piece holder 5 in a certain compressed state. Specifically, the compression spring 6 is suspended on the extensions 5*d*, 5*d* in a state that one end thereof is connected with the bottom wall 5*a* of the contact piece holder 5 by way of the movable contact piece 3, and the other end thereof is engaged with the downward extension (not shown) of the contact piece holder 5. More specifically, the bottom wall 5*a* of the contact piece holder 5 constitutes a first suspending portion for suspending the one end of the compression spring 6 by way of the movable contact piece 3, and the extensions 5*d*, 5*d* constitute a second suspending portion for suspending the other end of the compression spring 6. The one end 4*a* of the movable shaft 4 is received in the compression spring 6 and in the insertion hole 3*b* of the movable contact piece 3, and then inserted into the insertion hole 5*c* of the movable terminal 5 to thereby fixedly hold the movable shaft 4 in the holder 5 around the insertion hole 5*c*.

The switching device 1000 further comprises magnetic means (not shown) including a permanent magnet and a pair of magnetic members with the permanent magnet provided therebetween. The magnetic members are attached to the respective corresponding outer surfaces of the sealing vessel 1 in such a manner that the magnetic members sandwich the fixed contacts 2*a*, 2*a* and the movable contacts 3*a*, 3*a* therebetween. The magnetic means generates a magnetic field in the space where the contacts 2*a*, 2*a* are disposed in a direction orthogonal to the moving direction of the movable contacts 3*a*, 3*a*.

Next, the driving section B is described. The driving section B constitutes a magnet device along with the fixed iron core 7, the movable iron core 8, and the first joint member 11. A coil 13 is wound around a coil bobbin (coil frame) 14. A yoke (iron joint) 15 includes a yoke main body 15*a* and a bush 15*b*. The yoke 15 constitutes a magnet circuit along with the fixed iron core 7, the movable iron core 8, and the first joint member 11. The yoke main body 15*a* has a generally U-shape such that a bottom wall and a pair of opposing side walls encase the coil 13 therein. The bottom wall of the yoke main body 15*a* is formed with a through-hole 15*c* in the center thereof. The bush 15*b* has a cylindrical shape, and is fitted in the through-hole 15*c* of the yoke main body 15*a*. The cylindrical part 10*a* of the cylindrical member 10 is disposed between the bush 15*b* of the yoke 15 and the movable iron core 8 in a state that the bush 15*b* is fitted in the through-hole 15*c* of the yoke main body 15*a*.

Lastly, the housing C is described. The housing C is adapted to accommodate the sealed contact portion A and the driving section B therein. The housing C is formed with an insertion hole 16 for receiving the fixed terminal 2. The flange portion 2*c* of the fixed terminal 2, when received in the insertion hole 16, protrudes out of the housing C. The protruding part of the fixed terminal 2 is connected with a terminal plate (not shown) for connecting an electric wire.

Now, described are operations as to how the fixed terminals 2, 2, and the movable contact piece 3 are electrically communicable and discommunicable each other in the thus constructed electromagnetic switching device 1000 including a sealed contact device in response to an input signal.

Before energizing the coil 13, the movable contact 3*a* (3*a*) is opposed to the corresponding fixed contact 2*a* (2*a*) with a certain gap L1. When the coil 13 is energized in response to input of an operative signal to the electromagnetic switching device 1000, the movable iron core 8 is magnetically attracted to the fixed iron core 7 and is rendered movable. Thereby, the movable shaft 4, which is screwed to the movable iron core 8 and fixed thereto by an adhesive or the like, is driven. As the movable shaft 4 is driven, the gap L1 is gradually decreased with the result that the movable contact 3*a* (3*a*) contacts the corresponding fixed contact 2*a* (2*a*). Then, a load of the compression spring 6 is sharply raised. As the load of the compression spring 6 is sharply raised, the movable shaft 4 is further driven. As a result, the movable contact 3*a* (3*a*) is moved further toward the corresponding fixed contact 2*a* (2*a*) by an over-travel distance, thereby further increasing the load of the compression spring 6. The sum of the gap L1 and the over-travel distance corresponds to a stroke of the movable iron core 8.

When input of the operative signal is suspended, and the coil 13 is de-energized, the movable contact piece 3 is returned to its original position primarily by an urging force of the compression spring 6 and the return spring 9 to thereby displace in the direction opposite to the aforementioned direction relative to the fixed contacts 2*a*, 2*a*. Thus, the movable contact 3*a* (3*a*) is moved away from the corresponding fixed contact 2*a* (2*a*). Simultaneously, the movable iron core 8 is returned to its original state by displacing relative to the fixed iron core 7 by a certain distance. Arc developed between the contacts while the movable contact piece 3 and the movable iron core 8 are being returned to their respective original positions sufficiently spreads in the extending direction of the movable contact piece 3 toward the opposite ends thereof by a magnetic field generated by the magnetic means (not shown), whereby the developed arc is wiped out.

In the conventional device 1000, however, since the cylindrical member 10 is made of a non-magnetic material, as shown in FIG. 22, there exists a gap G between the bush 15*b* and the movable iron core 8, which may cause magnetic loss or lowering of electromagnetic attracting force. Therefore, it is highly likely that switching performance of the device 1000 may be deteriorated owing to increase of the dimensions of the electromagnetic portion of the device 1000 or lowering of a spring load. Further, in the conventional device 1000, it is required to continue applying an operative signal of a relatively large pulse to keep on electrically communicating between the fixed terminals 3, 3 (sic), and the movable contact piece 3. In the case where the device 1000 is used as a relay for power-driven load, it is preferable to suppress power consumption by the coil which is required in applying an operative signal. Further, in the case where the device 1000 is incorporated with a control circuit block on which a control circuit is formed so as to control driving of the contacts, it is preferable to electrically connect electrodes of the control circuit block with the coil with a simplified configuration.

Japanese Unexamined Patent Publication No. 9-259728 proposes a cylindrical member 10 of a three-piece structure including a closed bottom portion, a cylindrical part made of a magnetic material, and a cylindrical part made of a nonmagnetic material in order to overcome the drawback such that switching performance of the device is lowered due to increase of the dimensions of the electromagnetic portion of the device or lowering of the spring load. The arrangement disclosed in the publication can obviate the gap G between the bush 15*b* and the movable iron core 8. Specifically, as shown by the arrow X in FIG. 23, the attracting force of the electromagnetic portion of the device is raised from point Q to point Q', and the spring load W is increased as shown by the arrow Y in FIG. 23. Thus, the switching performance of the device can be improved. However, in the latter example where the cylindrical part has a three-piece structure, the number of parts constituting the device is increased, and the production cost is raised notwithstanding the improvement in magnetic efficiency of the electromagnetic portion.

As a measure for suppressing the power consumption by the coil, generally proposed is Pulse Width Modulation (PWM) control. However, in such a control, noise emitted from the coil is relatively large, which may adversely affect electronic parts in the vicinity of the coil and the electromagnetic switching device, etc.

DISCLOSURE OF THE INVENTION

An object of this invention is to provide an electromagnetic switching device with improved energy-saving performance as compared with the conventional electromagnetic switching devices. Another object of this invention is to provide an electromagnetic switching device that enables to reduce the number of parts of the device while improving magnetic efficiency of an electromagnet of a driving section of the device. Yet another object of this invention is to provide an electromagnetic switching device that enables to suppress power consumption required by a coil constituting an electromagnet as compared with the conventional electromagnetic switching devices. Still another object of this invention is to provide an electromagnetic switching device having a mechanism with which a control circuit block is easily connectable with the device, with a simplified construction and at a low cost.

To accomplish the aforementioned objects, according to an aspect of this invention, provided is an electromagnetic switching device including a cylindrical part made of a magnetic material with a closed bottom for housing a movable iron core having a movable contact and so constructed as to move the movable contact toward and away from a fixed contact, a joint member made of a metallic material with an insertion hole formed substantially in the center thereof for movably receiving a movable shaft fixedly attached to the movable iron core, and a metal plate made of a non-magnetic material with a hole formed substantially in the center thereof with the inner diameter substantially the same as the inner diameter of the cylindrical part, wherein the cylindrical part and the joint member are air-tightly jointed to each other with the metal plate provided therebetween, and the movable iron core is housed in the cylindrical part with a clearance defined by the movable iron core and the joint member corresponding to a required stroke within which the movable contact contacts the fixed contact.

According to another aspect of this invention, in an electromagnetic switching device constructed such that contacts are opened and closed by an electromagnet which is energized and de-energized in response to input of an operative signal, a coil constituting the electromagnet is comprised of a first coil which is energized at least at a time when the contacts are closed, and a second coil which is energized at least while the contacts are in a closed state.

According to yet another aspect of this invention, the aforementioned electromagnetic switching devices includes a control circuit block on which a control circuit is formed to control energizing and de-energizing of the electromagnet, and a connecting section for electrically connecting the control circuit and the coil each other.

BEST MODE FOR CARRYING OUT THE INVENTION

Figure 1:
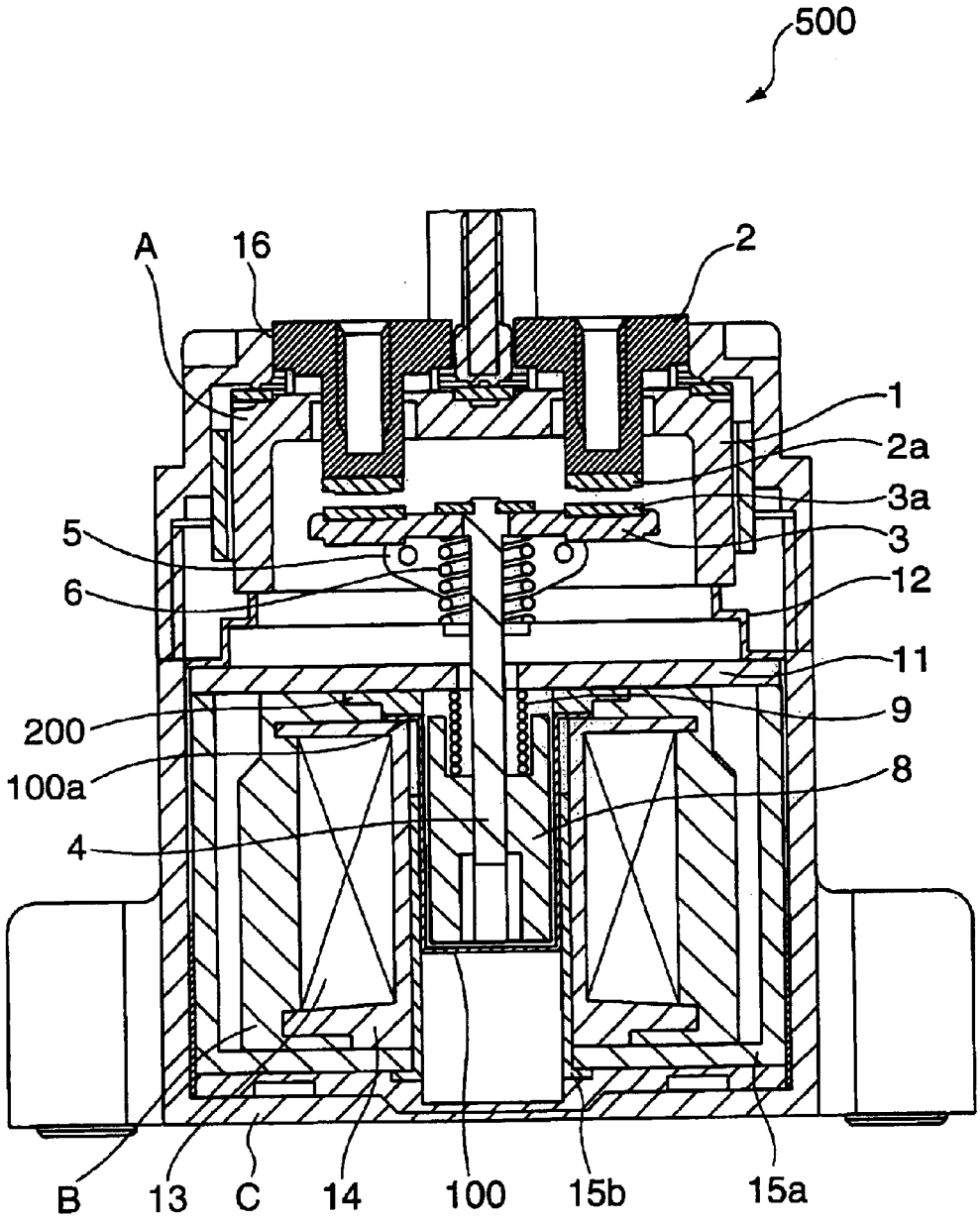
FIG. 1 is a side view in cross section showing an electromagnetic switching device as a first embodiment of this invention.

Hereinafter, preferred embodiments of this invention are described referring to the accompanying drawings. Like elements throughout the drawings are denoted at like reference numerals, and description thereof is omitted herein.

(First Embodiment)

Figure 21:
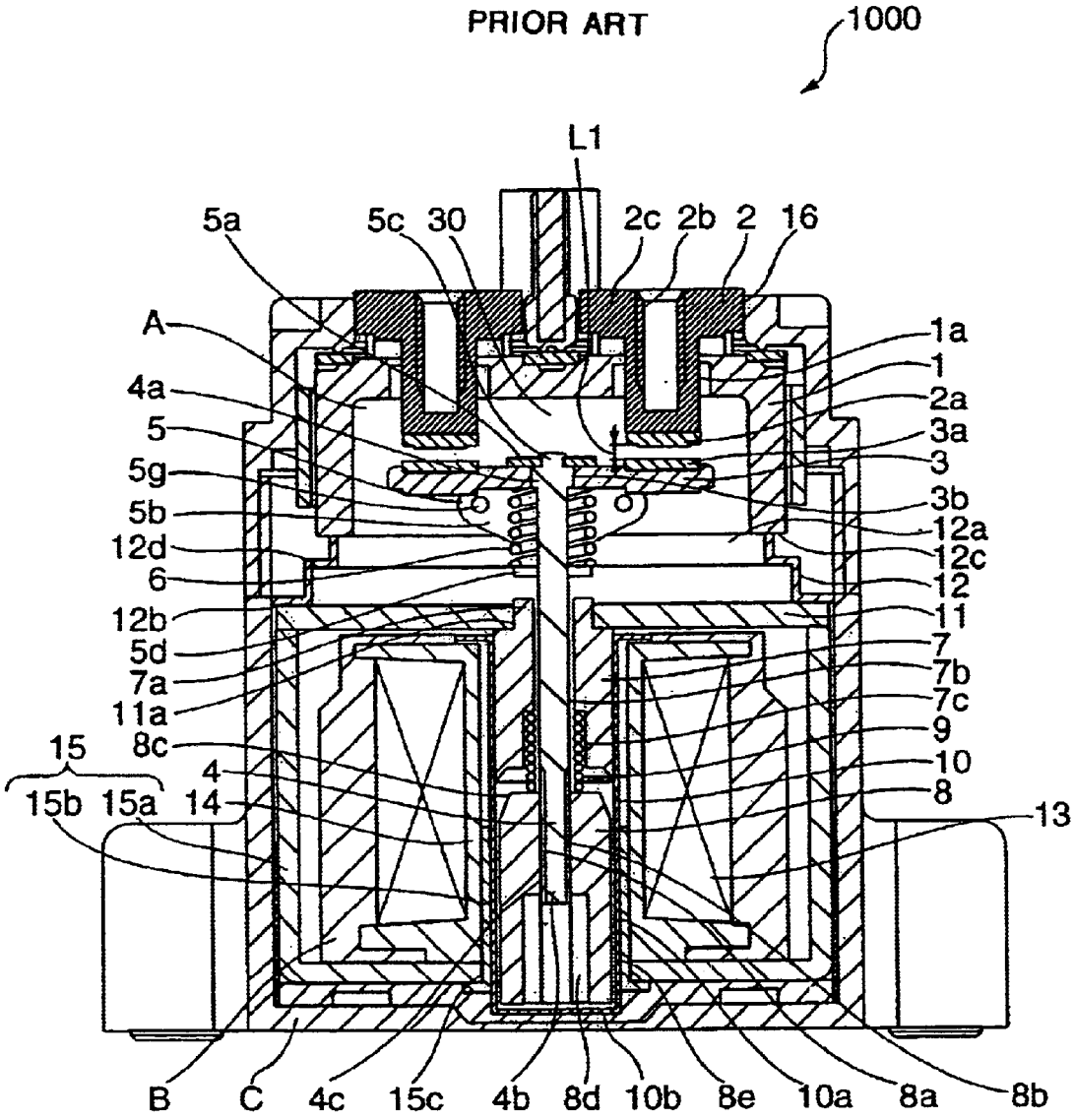
FIG.21 PRIOR ART
FIG. 21 is a side view in cross section showing a conventional electromagnetic switching device.
Figure 22:
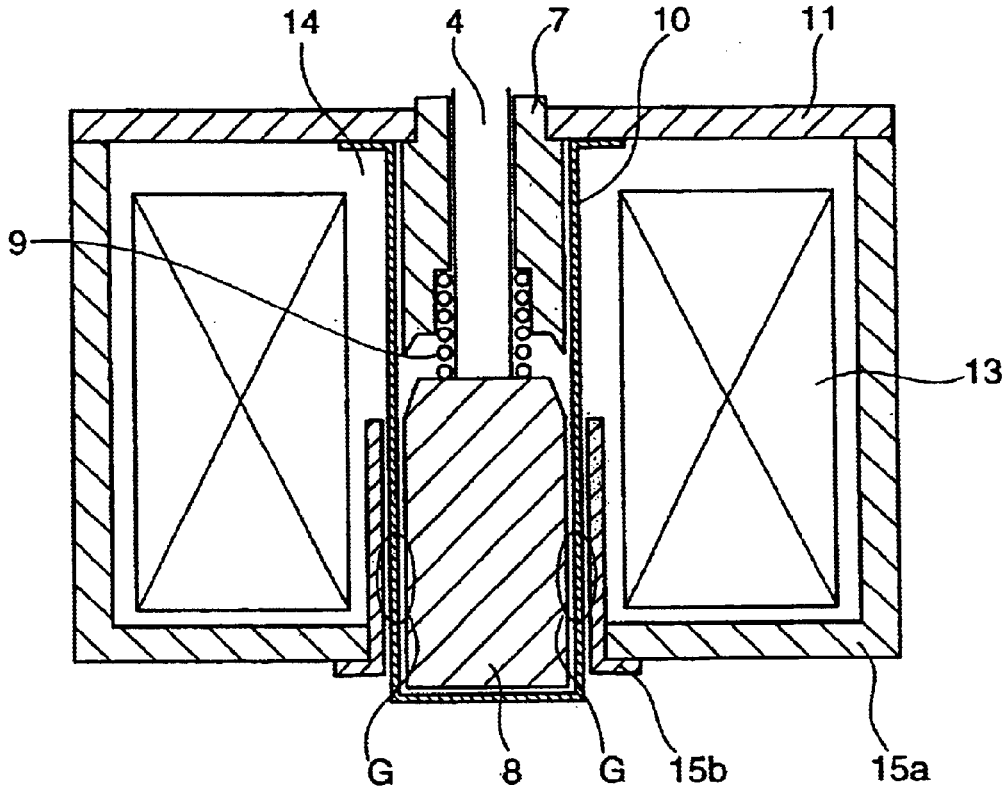
FIG.22 PRIOR ART
FIG. 22 is a side view in cross section showing essential parts of the conventional electromagnetic switching device.
Figure 23:
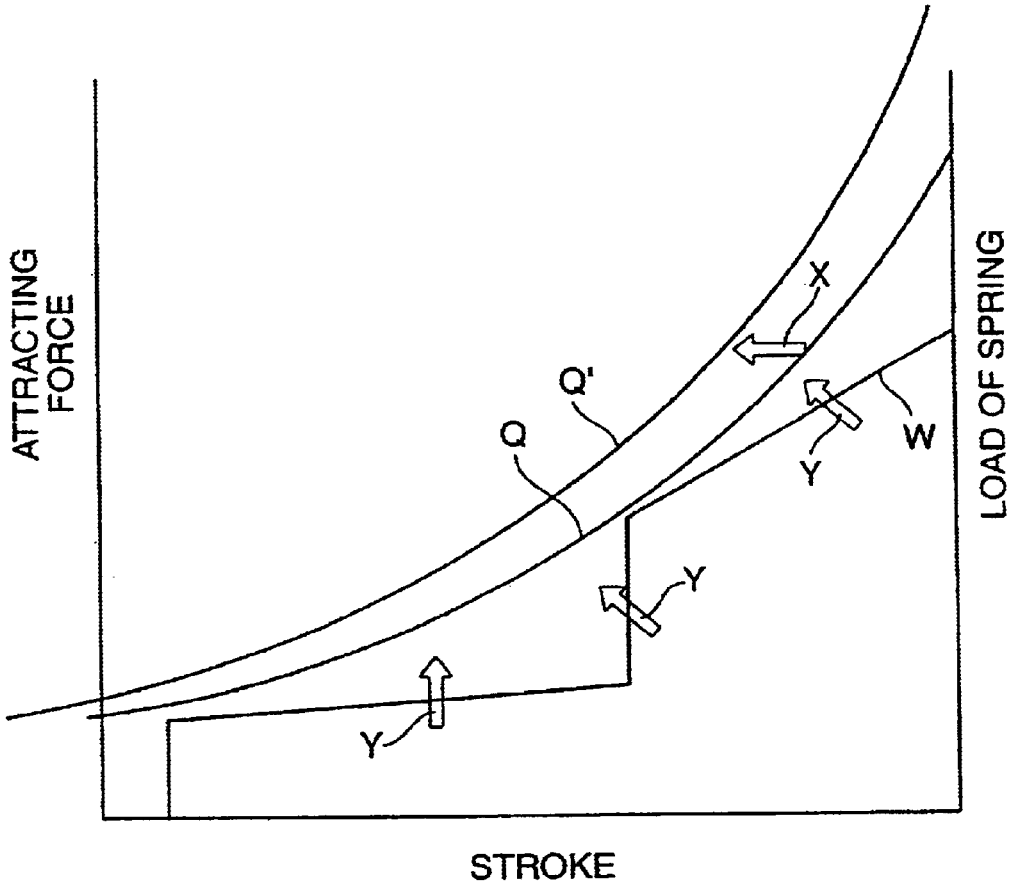
FIG.23 PRIOR ART
FIG. 23 is an illustration for explaining an effect of a conventional electromagnetic switching device.

FIG. 1 is a side view in cross section showing an electromagnetic switching device as a first embodiment of this invention. Since the basic construction of the first electromagnetic switching device is identical to that of the conventional device, merely the characterizing part of the first electromagnetic switching device will be described herein. Specifically, the first electromagnetic switching device 500 including a sealed contact device is different from the conventional electromagnetic switching device 1000 including a conventional sealed contact device in that: the fixed iron core 7 in FIG. 21 is eliminated; a cylindrical member 100 made of a magnetic material with a closed bottom is provided in place of the cylindrical member 10 made of a non-magnetic material as shown in FIG. 21; a metal plate 200 made of a non-magnetic material is provided between the cylindrical member 100 and a first joint member 11; and the respective parts are air-tightly jointed with each other by laser welding or the like.

Figure 2:
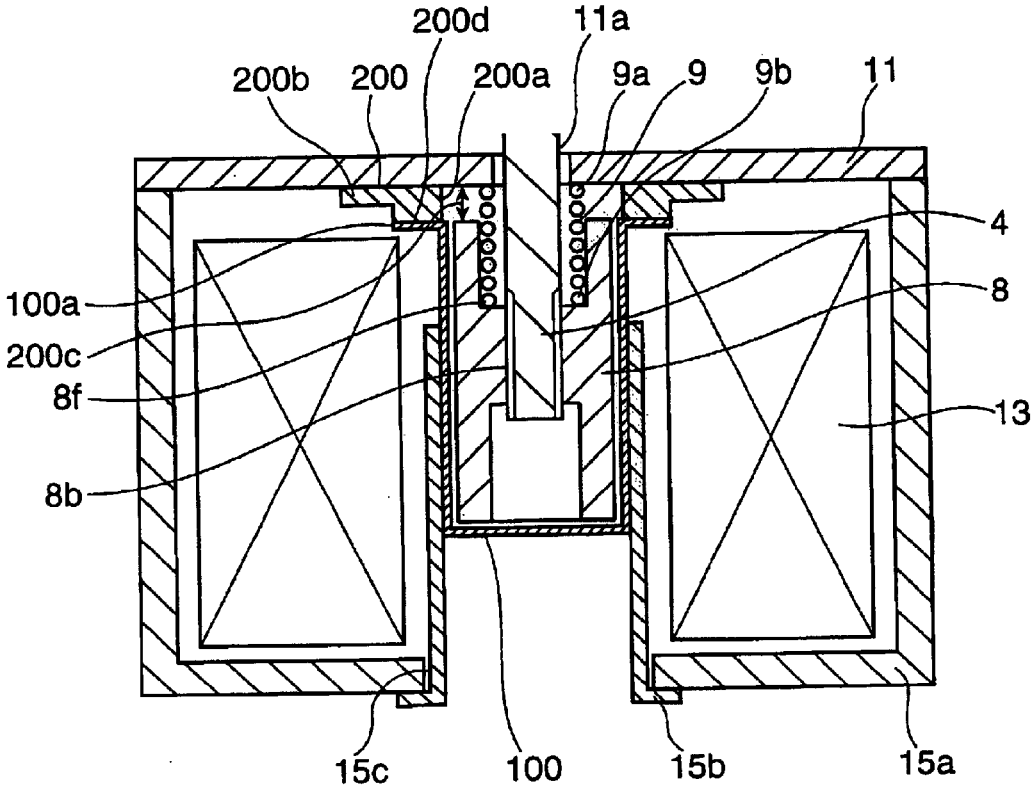
FIG. 2 is a side view in cross section showing essential parts of the first electromagnetic switching device.
Figure 3:
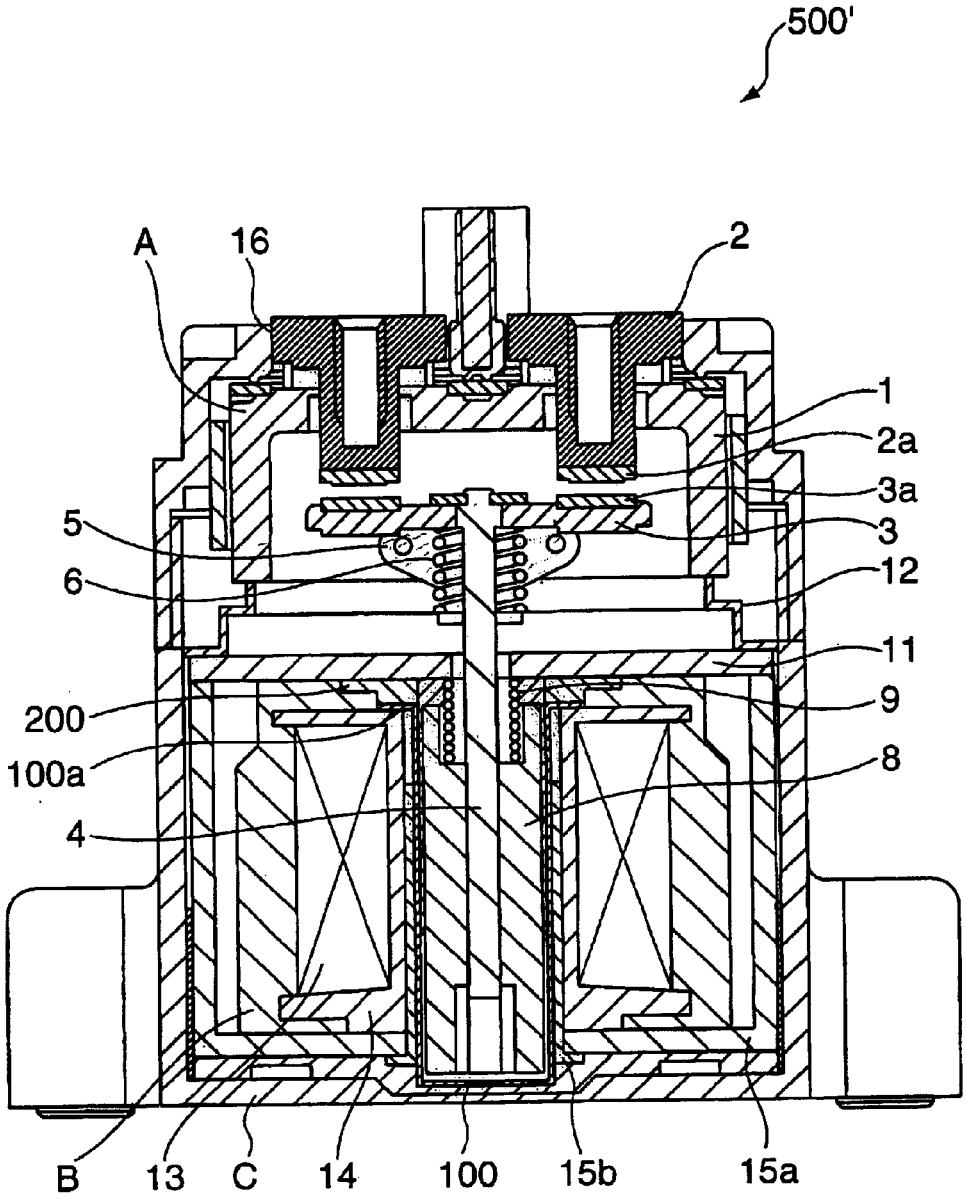
FIG. 3 is a side view in cross section showing an altered arrangement of the first electromagnetic switching device.

The first device 500 is described in detail referring to FIGS. 1 and 2. The magnetic cylindrical member 100 has a flange portion 100*a* at an axially one end corresponding to an open end thereof to be jointed to the non-magnetic metal plate 200. The length of the open one-end of the cylindrical member 100 to the other end on the bottom surface thereof is substantially identical to the entire length of a movable iron core 8. FIG. 3 is a side view in cross section showing an altered arrangement of the first device 500. As shown in FIG. 3, it may be possible to construct a first electromagnetic switching device 500' as an altered example such that a movable iron core 8 and a cylindrical member 100 with a closed bottom for housing the movable iron core 8 therein may contact the bottom portion of a housing C.

The non-magnetic metal plate 200 is formed with a hollow 200*a* generally in the center thereof having the inner diameter substantially the same as that of the cylindrical member 100. The non-magnetic metal plate 200 has a thickness 200*c* substantially the same as a stroke within which the movable iron core 8 is movable toward and away from the first joint member 11. The non-magnetic metal plate 200 is further formed with a joint portion 200*d* to be jointed to the flange portion 100*a* of the cylindrical member 100, and a flange portion 200*b* to be jointed to the first joint member 11. The flange portion 100*a* of the cylindrical member 100 and the joint portion 200*d* of the metal plate 200 are air-tightly jointed each other by laser welding or the like. Likewise, the flange portion 200*b* of the metal plate 200 and the first joint member 11 are air-tightly jointed by laser welding or the like.

The first joint member 11 is formed with an insertion hole 11*a* substantially in the center thereof for receiving a movable shaft 4. The first joint member 11 is adapted to position the movable iron core 8 relative thereto. The movable iron core 8 is formed with a recess 8*f* in a surface thereof opposing the first joint member 11 having the inner diameter larger than the diameter of the concave portion of a screw groove 8*b*. With this arrangement, the movable iron core 8 is housed in the cylindrical member 100 with a clearance defined by the movable iron core 8 and the first joint member 11 corresponding to a stroke within which movable contacts 3*a*, 3*a* are movable toward and away from respective corresponding fixed contacts 2*a*, 2*a*. A return spring 9 is configured into a coil spring and has the inner diameter slightly larger than the inner diameter of the insertion hole 11*a* of the first joint member 11. When the movable shaft 4 is passed in the insertion hole 11*a* of the first joint member 11 with the return spring 9 being fitted over the movable shaft 4 in a state that one end 9*a* of the return spring 9 is suspended on the first joint member 11 and the other end 9*b* thereof is fitted in the recess 8*f* of the movable iron core 8, the movable iron core 8 is positioned relative to the first joint member 11.

In the first electromagnetic switching device 500 and the first altered electromagnetic switching device 500', since the cylindrical member 100 is made of a magnetic material, there is no likelihood that a gap is defined between a bush 15*b* and the movable iron core 8. Thereby, the first device 500 and the first altered device 500' can provide improved magnetic efficiency of electromagnet. Further, since the metal plate 200 is made of a non-magnetic material, it is less likely that magnetic flux may flow directly from the magnetic cylindrical member 100 to the first joint member 11, thereby suppressing lowering of magnetic efficiency of an electromagnet of the device.

Now, another embodiment of this invention is described.

(Second Embodiment)

Figure 4:
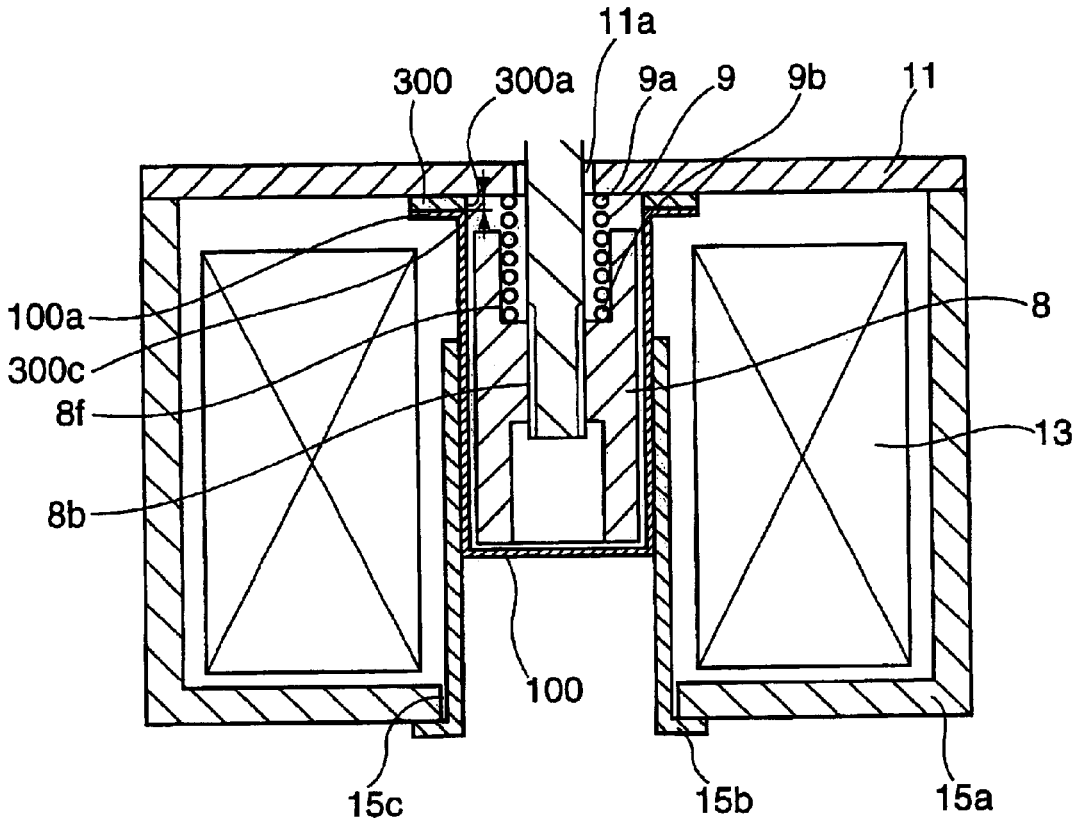
FIG. 4 is a side view in cross section showing essential parts of an electromagnetic switching device as a second embodiment of this invention.

FIG. 4 is a side view in cross section showing essential parts of an electromagnetic switching device as a second embodiment of this invention. Since the basic construction of the second electromagnetic switching device is identical to that of the conventional device, merely the characterizing part of the second electromagnetic switching device will be described herein. Specifically, the second electromagnetic switching device including a sealed contact device is different from the conventional electromagnetic switching device 1000 including a conventional sealed contact device in that: the fixed iron core 7 in FIG. 21 is eliminated; a cylindrical member 100 made of a magnetic material with a closed bottom is provided in place of the cylindrical member 10 made of a non-magnetic material shown in FIG. 21; a metal plate 300 made of a non-magnetic material is provided between the cylindrical member 100 and a first joint member 11; and the respective parts are air-tightly jointed with each other simultaneously by laser welding or the like.

The magnetic cylindrical member 100 is described in further detail. The cylindrical member 100 has a flange portion 100*a* at an axially one end thereof corresponding to an open end to be jointed to a non-magnetic metal plate 300. The non-magnetic metal plate 300 is formed with a hollow 300*a* substantially in the center thereof having the diameter substantially the same as the inner diameter of the cylindrical member 100. The metal plate 300 has a thickness 300*c* having such a thickness as to be jointed to the flange portion 100*a* of the cylindrical member 100 and to the first joint member 11 simultaneously by laser welding or the like. The metal plate 300 is jointed air-tightly to the flange portion 100*a* of the cylindrical member 100 and to the first joint member 11 simultaneously by laser welding or the like.

The first joint member 11 is formed with an insertion hole 11*a* substantially in the center thereof for receiving a movable shaft 4. The first joint member 11 is adapted to position the movable iron core 8 relative thereto. The movable iron core 8 is formed with a recess 8*f* in a surface thereof opposing the first joint member 11 having the inner diameter larger than the diameter of the concave portion of a screw groove 8*b*. A return spring 9 is configured into a coil spring and has the inner diameter slightly larger than the inner diameter of the insertion hole 11*a* of the first joint member 11. When the movable shaft 4 is passed in the insertion hole 11*a* of the first joint member 11 with the return spring 9 being fitted over the movable shaft 4 in a state that one end 9*a* of the return spring 9 is suspended on the first joint member 11 and the other end 9*b* thereof is fitted in the recess 8*f* of the movable iron core 8, the movable iron core 8 is positioned relative to the first joint member 11.

In the second electromagnetic switching device including a sealed contact device, since the cylindrical member 100 is made of a magnetic material, there is no likelihood that a gap is defined between a bush 15*b* and the movable iron core 8, thereby providing improved magnetic efficiency of an electromagnet of the device. Further, since the metal plate 300 is made of a non-magnetic material, it is less likely that magnetic flux may flow directly from the magnetic cylindrical member 100 to the first joint member 11, thus suppressing lowering of magnetic efficiency of the electromagnet.

Next, described are embodiments with improved energy saving performance as compared with the electromagnetic switching device 1000 including a conventional sealed contact device. The electromagnetic switching devices in accordance with third through sixth embodiments of this invention are constructed such that a coil comprises a first coil and a second coil in place of a coil 13 corresponding to the coil 13 provided in the conventional device, and timing of energizing and de-energizing the first and second coils is so controlled as to achieve improved energy saving performance. First, the third embodiment of this invention is described.

(Third Embodiment)

Figure 5:
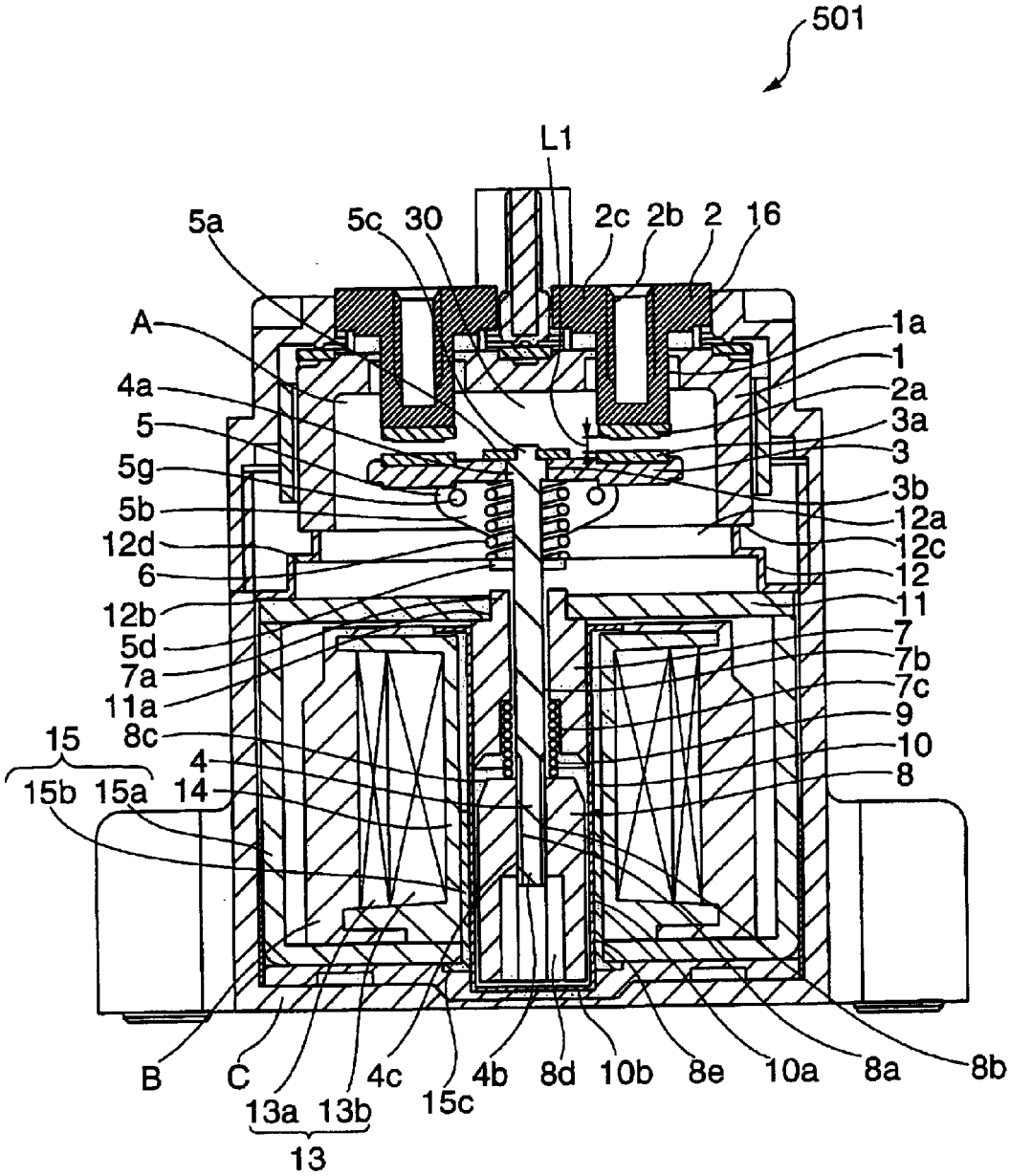
FIG. 5 is a front view in cross section showing the second electromagnetic switching device.
Figure 6:
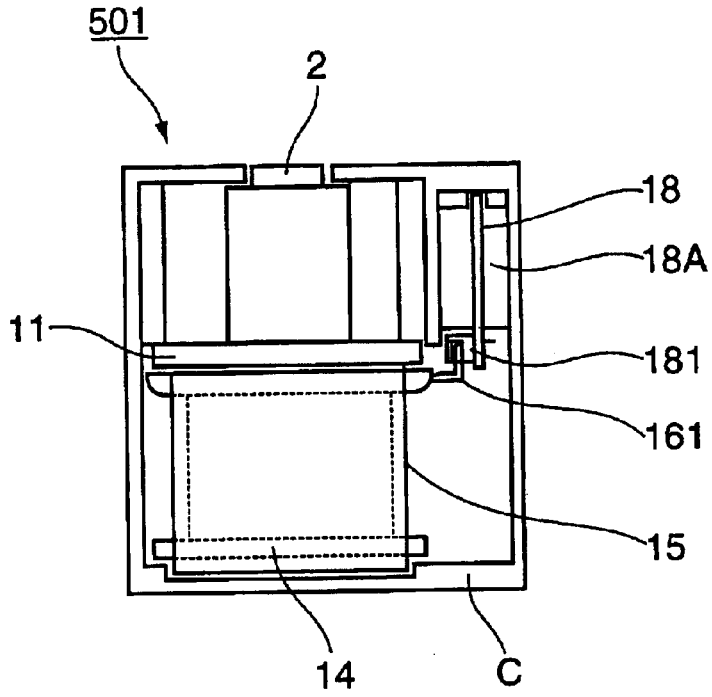
FIG. 6 is a side view in cross section showing the second electromagnetic switching device.
Figure 7:
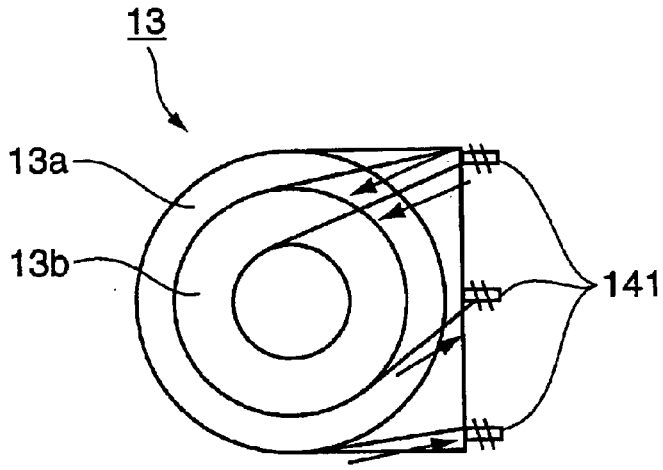
FIG. 7 is a top plan view in section showing a coil in the second electromagnetic switching device.
Figure 8:
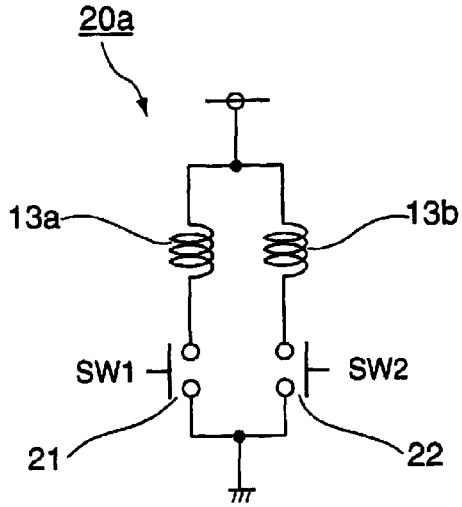
FIG. 8 is a circuit diagram for explaining a circuit used in an electromagnetic switching device as a third embodiment of this invention.

FIGS. 5 through 8 are an illustration showing an electromagnetic switching device as the third embodiment of this invention. FIGS. 5 and 6 are a front view in section and a side view in section showing the third device. FIG. 7 is a top plan view in section showing a coil. FIG. 8 is a circuit diagram for explaining a circuit for use in the third device.

The third electromagnetic switching device 501 including a sealed contact device comprises a sealing vessel 1 made of an insulating material, fixed terminals 2, 2 having fixed contacts 2*a*, 2*a* to be air-tightly jointed to the sealing vessel 1, a movable contact piece 3 which is movable toward and away from the fixed contacts 2*a*, 2*a*, a movable iron core 8 which is movable in one direction, a cylindrical member 10 with a dosed bottom for housing a movable iron core 8 therein, a first joint member 11 to be air-tightly jointed to the cylindrical member 10, a movable shaft 4 coupled to the movable iron core 8, a compression spring 6 which urges the movable contact piece 3 in such a direction as to urge movable contacts 3*a*, 3*a* toward the corresponding fixed contacts 2*a*, 2*a*, a retainer 12 which retains the compression spring 6 in a compressed and suspended state so as to operatively link the movable contact piece 3 to the movable shaft 4, a return spring 9 for urging the movable iron core 8 in one direction, a unit of a yoke 15 and a coil 13 for magnetically attracting and driving the movable iron core 8, a coil bobbin 14 around which the coil 13 is wound, a housing C, and a control circuit block 18 incorporated with a control circuit (not shown) for controllably energizing and de-energizing the coil 13. The control circuit block 18 and the coil 13 are electrically connected with each other. The coil 13 includes a power application coil (first coil) 13*a* and a power retaining coil (second coil) 13*b*.

A circuit 20*a* for use in the third device is configured, as shown in FIG. 8, such that the power application coil 13*a* and the power retaining coil 13*b* are connected in parallel to each other, and a first switch 21 for applying power to the power application coil 13*a* for a predetermined duration in response to input of an operative signal to the device, and a second switch 22 for applying power to the power retaining coil 13*b* are connected in parallel to each other. The power application coil 13*a* is energized at least at a time when the contacts are closed, whereas the power retaining coil 13*b* is energized at least while the contacts are in a closed state.

As shown in FIG. 7, the power application coil 13*a* is wound on a radially outward side of the coil 13, whereas the power retaining coil 13*b* is wound on a radially inward side of the coil 13. Power is applied to the coils 13*a*, 13*b* such that magnetic fluxes generated along the central axes of the coils 13*a*, 13*b* are directed substantially in identical directions to each other. With this configuration, magnetomotive force generated by the coils 13*a*, 13*b* is effectively utilized, and counterelectromotive force generated when the coils 13*a*, 13*b* are de-energized can be suppressed at a relatively low level.

Next, yet another embodiment of this invention is described.

(Fourth Embodiment)

The fourth embodiment is directed to an electromagnetic switching device using a circuit 20*b* as an altered arrangement of the circuit 20*a* in the third embodiment. Since the arrangement of the fourth device is basically the same as that of the third device which has been described referring to FIGS. 5 through 7, description on the identical parts is omitted herein, and the circuit 20*b* which is an alteration of the circuit 20*a* is described.

Figure 9:
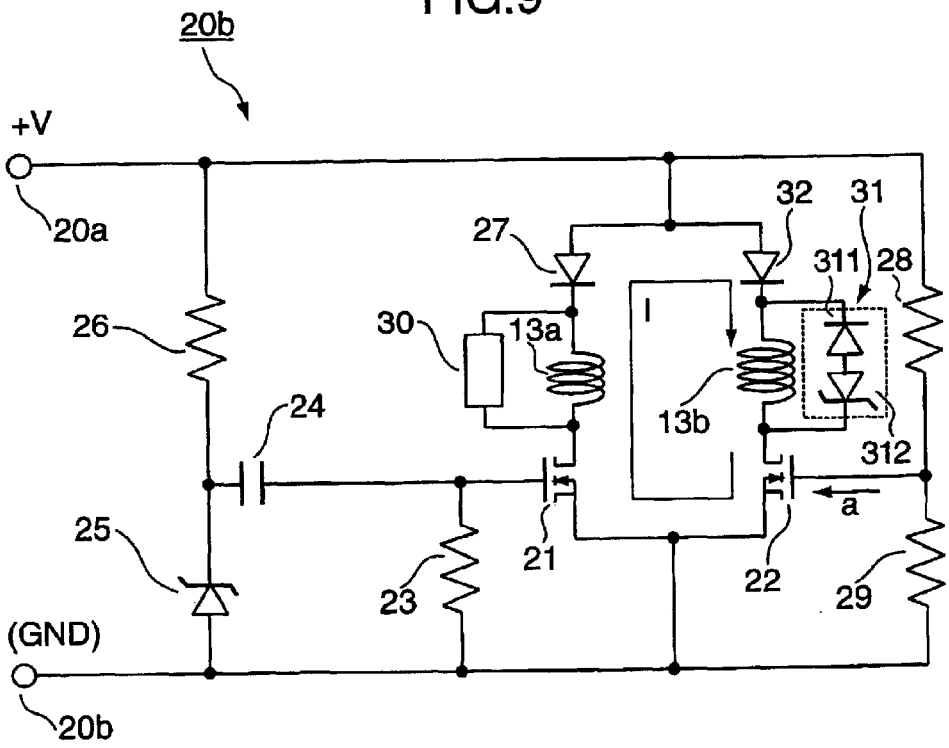
FIG. 9 is a circuit diagram for explaining operation of the circuit used in an electromagnetic switching device as a fourth embodiment of this invention.

FIG. 9 is a circuit diagram for explaining a circuit for use in the fourth electromagnetic switching device.

The circuit 20*b* in the fourth embodiment is configured such that a power application coil (first coil) 13*a* and a power retaining coil (second coil) 13*b* are connected in parallel to each other between input terminals 20*a*, 20*b* (sic).

A MOSFET (first switch) 21 is serially connected with the power application coil 13*a*. A resistor 23, and a circuit in which a capacitor 24 and a Zener diode 25 are serially connected with each other are connected in parallel to each other between the gate and the source of the MOSFET 21. An input terminal 20*a* (sic) is connected with a connecting point between the capacitor 24 and the Zener diode 25 by way of a resistor 26.

The power retaining coil 13*b* is serially connected with a MOSFET (second switch) 22. The gate of the MOSFET 22 is connected with a connecting point between a resistor 28 and a resistor 29 which are serially connected between the input terminals 20*a* and 20*b* (sic).

The power application coil 13*a* and the power retaining coil 13*b* are respectively connected in parallel to elements 30 and 31 adapted for surge absorption, and are serially connected with diodes 27 and 32, respectively. This arrangement makes it possible to suppress a drawback that the contact parting velocity of the contacts is lowered at the time of turning off the electromagnetic switching device, thereby suppressing deterioration of power cut-off performance on the output side of the device. Further, this configuration makes it possible to block electric current from flowing in the power application coil 13*a* and the power retaining coil 13*b* in the case where power is applied in the direction opposite to the direction along which power should be applied, as a result of erroneous judgment of polarity of an input voltage which is to be applied between the input terminals 20*a*, 20*b* (sic). Alternatively, a conducting wire may be used in place of the diode 32 in view of the fact that even if power is applied to the power retaining coil 13*b*, the contacts are kept in an inoperative state. The surge absorbing element 31 may be configured, for instance, by serially connecting a diode 311 and a Zener diode 312. It is needless to say that a conducting wire may be used in place of the surge absorbing element 30 (31).

Figure 10:
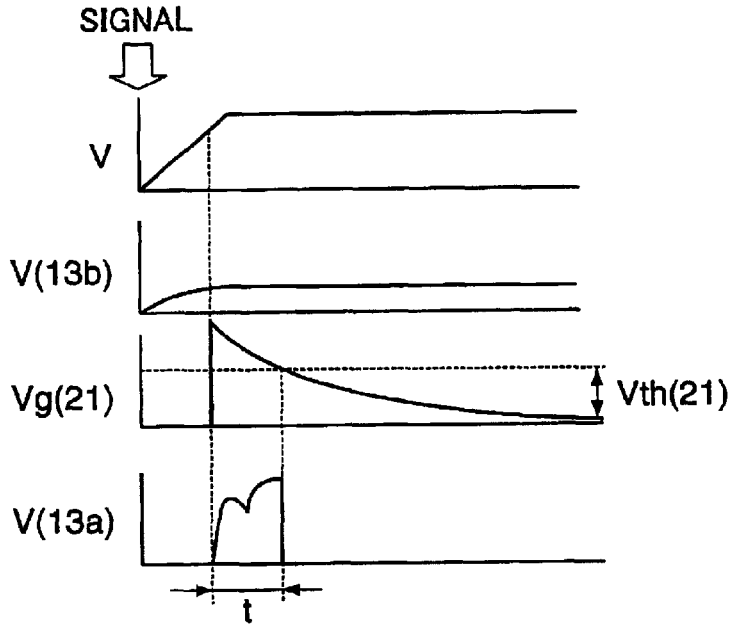
FIG. 10 is an illustration for explaining operation of the fourth electromagnetic switching device.

Next, operation of the circuit 20*b* is described referring to FIG. 10. FIG. 10 is an illustration for explaining operation of the circuit used in the fourth electromagnetic switching device.

Referring to FIG. 10, when an input voltage V is applied between the input terminals 20*a*, 20*b* (sic), a voltage defined by the voltage dividing ratio based on the resistor 28 and the resistor 29 is applied to the gate of the MOSFET 22 to electrically communicate between the drain and the source of the MOSFET 22. Upon electrical communication between the drain and the source of the MOSFET 22, the voltage V(13*b*) detected at the opposite ends of the power retaining coil 13*b* is raised, thereby allowing electric current to flow through the power retaining coil 13*b*. Referring to the gate of the MOSFET 21, after a voltage of a certain level defined by the resistors 23, 26 and the like is applied to the gate of the MOSFET 21, the gate voltage Vg(21) of the MOSFET 21 is gradually lowered depending on a time constant defined by the resistor 23, the capacitor 24, and the Zener diode 25. Since current flows between the drain and the source of the MOSFET 21 during a predetermined duration t while the gate voltage Vg(21) of the MOSFET 21 exceeds a threshold value Vth(21) of the MOSFET 21, the voltage V(13*a*) detected at the opposite ends of the power application coil 13*a* is raised with the result that current flows through the power application coil 13*a*.

In other words, the power application coil 13*a* is energized for the predetermined duration t by current flowing therethrough, whereby the movable iron core 8 is magnetically attracted to the fixed iron core 7 owning to a relatively large magnetic attracting force with the result that the movable contact piece 3 is rendered in contact with the fixed contacts 2*a*, 2*a* (see FIG. 1). Upon lapse of the predetermined duration t, current flow through the power application coil 13*a* is ceased, and consequently, current flows merely through the power retaining coil 13*b*, and merely the power retaining coil 13*b* is kept on energizing. However, since a large magnetic attracting force is not required after the movable contact piece 3 contacted the fixed contacts 2*a*, 2*a*, the contact state is securely retained. Since current flows merely through the power retaining coil 13*b*, power consumption relating to the input operation can be suppressed at a relatively low level. Further, this arrangement can obviate emission of noise from the coil, unlike PWM control which has been mentioned above.

Constituting the power application coil 13*a* of a relatively thick conducting wire is advantageous in that a larger magnetic force can be generated when current flows through such a thick wire. This arrangement can further shorten the time required for contacting. Conversely, constituting the power retaining coil 13*b* of a relatively thin conducting wire is advantageous in suppressing power consumption required in contacting.

Further, since the duration t during which current is allowed to flow through the power application coil 13*a* can be regulated based on a circuit constant with respect to the resistor 23, the capacitor 24, and the Zener diode 25, it is possible to configure the circuit such that current flows merely for a duration required for contacting. Such an arrangement eliminates a likelihood that the temperature of the power application coil 13*a* is unexpectedly raised due to continuous power application thereto, which may lead to burn-out or damage of the coil 13*a*.

It may be possible to use a conducting wire in place of the diode 27 (32), or to control the MOSFET (second switch) 22 based on a signal from an external device. It is needless to say that such an alteration does not impair the aforementioned operations and effects of this invention.

Next, a further embodiment of this invention is described.

(Fifth Embodiment)

The fifth embodiment is directed to an electromagnetic switching device using a circuit 20*c* as a further alteration of the circuit 20*a* used in the third embodiment. Since the arrangement of the fifth device is basically the same as that of the third device which has been described referring to FIGS. 5 through 7, description on the identical parts is omitted herein, and the circuit 20*c* which is an alteration of the circuit 20*a* is described.

Figure 11:
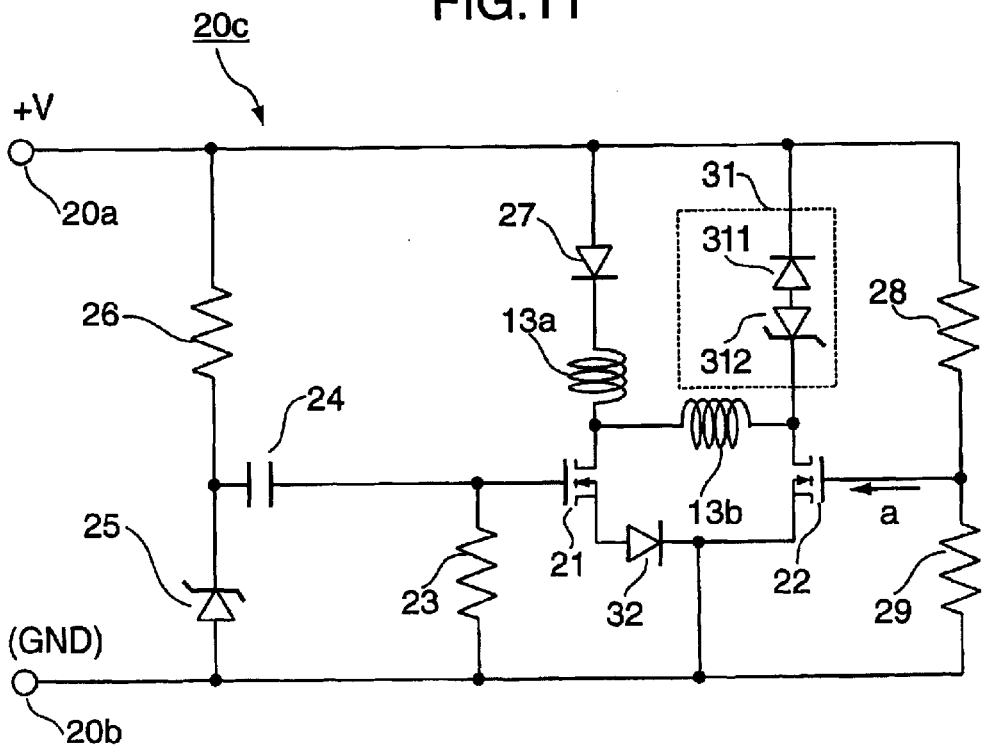
FIG. 11 is a circuit diagram for explaining a circuit used in an electromagnetic switching device as a fifth embodiment of this invention.

FIG. 11 is an illustration for explaining the circuit used in the fifth electromagnetic switching device.

Referring to FIG. 11, the circuit 20*c* in the fifth embodiment is different from the one in the fourth embodiment in that a power application coil (first coil) 13*a* and a power retaining coil (second coil) 13*b* are serially connected each other between input terminals 20*a*, 20*b* (sic) in the fifth embodiment.

Specifically, the circuit 20*c* is configured such that: in addition to the feature that the power application coil 13*a* and the power retaining coil 13*b* are serially connected, a circuit in which the power retaining coil 13*b* and a MOSFET (second switch) 22 are serially connected, and a circuit in which a MOSFET (first switch) 21 and a diode 32 are serially connected are connected in parallel to each other; a resistor 23, and a circuit in which a capacitor 24 and a Zener diode 25 are serially connected are connected in parallel to each other between the gate and the source of the MOSFET 21, wherein a connecting point between the capacitor 24 and the Zener diode 25 is connected to the input terminal 20*a* (sic) by way of a resistor 26; the gate of the MOSFET 22 is connected with a connecting point between a resistor 28 and a resistor 29 which are serially connected between the input terminals 20*a*, 20*b* (sic); the power application coil 13*a* is serially connected with a diode 27; and a surge absorbing element 31 is connected with the diode 27, the power application coil 13*a*, and the power retaining coil 13*b* in parallel thereto. Since the power retaining coil 13*b* is connected with the diode 32 in parallel thereto, a voltage corresponding to falling of the voltage of the diode 32 is applied between the opposite ends of the power retaining coil 13*b* when the circuit is shifted to a state of retaining the contact upon turning off of the MOSFET 21. This arrangement can shorten a period until power retaining and attracting force is stabilized and thus provides stable power retaining state.

In the above configuration, current is allowed to flow merely to the power application coil 13*a* during the predetermined duration t when an input voltage V is applied between the input terminals 20*a*, 20*b* (sic), while current is blocked from flowing through the power retaining coil 13*b*. In this arrangement, current flows both in the power application coil 13*a* and the power retaining coil 13*b* while the device is in a contact state although magnetic attracting force is relatively lessened. Thus, the fifth device provides more stable power retaining state as compared with the arrangement of the third device.

It may be possible to use a conducting wire in place of the diode 27 (32), or to control the MOSFET (second switch) 22 based on a signal from an external device. It is needless to say that such an alteration does not impair the aforementioned operations and effects of this invention.

Next, a further embodiment of this invention is described. (Sixth Embodiment)

The sixth embodiment is directed to an electromagnetic switching device using a circuit 20*d* as a further alteration of the circuit 20*a* used in the third embodiment. Since the arrangement of the sixth device is basically the same as that of the third device which has been described referring to FIGS. 5 through 7, description on the identical parts is omitted herein, and the circuit 20*d* which is an alteration of the circuit 20*a* is described.

Figure 12:
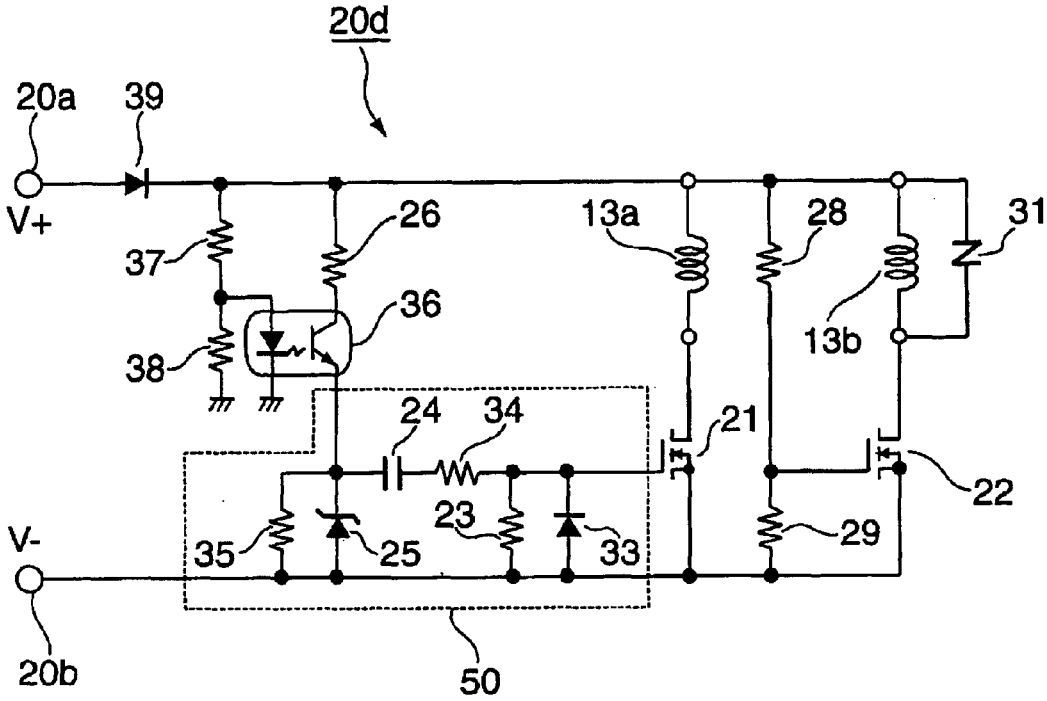
FIG. 12 is a circuit diagram for explaining a circuit used in an electromagnetic switching device as a sixth embodiment of this invention.

FIG. 12 is a circuit diagram for explaining the circuit for use in the sixth electromagnetic switching device.

Referring to FIG. 12, the circuit 20*d* in the sixth embodiment has a feature that a power application coil (first coil) 13*a* and a power retaining coil (second coil) 13*b* are connected in parallel to each other between input terminals 20*a*, 20*b* (sic).

Specifically, the circuit 20*d* is configured such that: a diode 39 having an anode connected with the input terminal 20*a* (sic), the power application coil 13*a* having one end connected with the cathode of the diode 39 and the other end connected with the drain of a MOSFET (first switch) 21, which is described later, and the MOSFET 21 whose drain is connected to the other end of the power application coil 13*a* and whose source is connected to the input terminal 20*b* (sic) are serially connected each other; the power retaining coil 13*b*, and a MOSFET (second switch) 22 whose drain is connected with the power retaining coil 13*b* and whose source is connected with the input terminal 20*b* (sic) are serially connected each other between the cathode of the diode 39 and the input terminal 20*b* (sic); a surge absorbing element 31 is connected with the power retaining coil 13*b* in parallel thereto; a resistor 28 is connected between the cathode of the diode 39 and the gate of the MOSFET 22; and a resistor 29 is connected between the gate of the MOSFET 22 and the input terminal 20*b* (sic). The surge absorbing element 31 absorbs counterelectromotive force generated when power application to the power retaining coil 13*b* is suspended so as to promptly open the output side (contact between the fixed contacts 2*a*, 2*a* and the corresponding movable contacts 3*a*, 3*a* (see FIG. 1)) of the electromagnetic switching device. Such an arrangement may be accomplished by, e.g., a circuit in which a varistor, a diode and a power Zener diode are serially connected each other.

Further, a so-called one-shot-pulse circuit 50 is connected between the gate and the source of the MOSFET 21, and a so-called voltage-reactive-electronic switch (third switch) 36 is connected between the cathode of the diode 39 and the one-shot-pulse circuit 50.

The one-shot-pulse circuit 50 is adapted to generate a voltage of a certain level between the gate and the source of the MOSFET 21 for a predetermined duration depending on the level of the input voltage. The one-shot-pulse circuit 50 is configured such that: a resistor 34 having one end connected to the gate of the MOSFET 21 and the other end connected to a capacitor 24, which will be described later, the capacitor 24 connected between the resistor 34 and the cathode of a Zener diode 25, which will be described later, and the Zener diode 25 whose cathode is connected to the capacitor 24 and whose anode is connected to the source of the MOSFET 21 are serially connected each other; a resistor 23, and a diode 33 whose cathode is connected to the gate of the MOSFET 21 and whose anode is connected to the source of the MOSFET 21 are connected in parallel to each other; and the Zener diode 25 is connected to a resistor 35 in parallel thereto.

The voltage-reactive-electronic switch 36 is adapted to activate the one-shot-pulse circuit 50 when the input voltage (input signal) exceeds a predetermined value, and is comprised of a photo transistor coupler 36. Specifically, the photo transistor coupler 36 has an input side connected to a connecting point between a resistor 37 and a resistor 38 which are serially connected each other between the cathode of the diode 39 and the ground terminal, and an output side having one end connected to the cathode of the diode 39 by way of a resistor 26 and the other end thereof connected to a connecting point between the capacitor 24 and the Zener diode 25. The voltage-reactive electronic switch 36 may be comprised of; e.g., a low-voltage-driven MOSFET. In the altered arrangement, it is preferable to connect the gate of the MOSFET with the connecting point between the resistor 37 and the resistor 38, the drain of the MOSFET with the resistor 26, and the source of the MOSFET with the connecting point between the capacitor 24 and the Zener diode 25, respectively.

Figure 13:
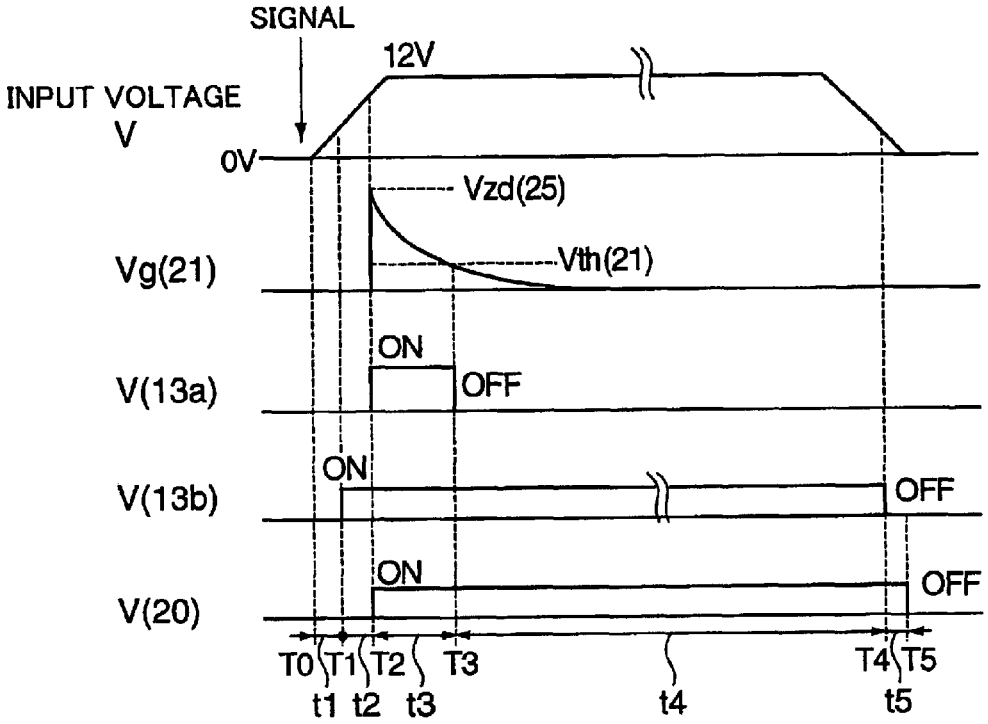
FIG. 13 is an illustration for explaining operation of a circuit used in the sixth electromagnetic switching device.

Now, operation of the circuit 20*d* having the above configuration is described with reference to FIG. 13. FIG. 13 is an illustration for explaining operation of the circuit used in the sixth electromagnetic switching device. Referring to FIG. 13, when input voltage V is applied between the input terminals 20*a*, 20*b* (sic) at time T0, a voltage defined by the voltage dividing ratio based on the resistors 28, 29 is applied to the gate of the MOSFET 22. Then, when the voltage exceeds a threshold value Vth(21) of the MOSFET 22 upon lapse of duration t1, current is allowed to flow between the drain and the source of the MOSFET 22. Then, voltage V(13*b*) detected at the opposite ends of the power retaining coil 13*b* is raised, whereby current starts to flow through the power retaining coil 13*b*. (at time T1).

On the other hand, a voltage defined by the voltage dividing ratio based on the resistors 37 and 38 is applied to the input side of the photo transistor coupler 36. When the voltage reaches in between 0.7 to 1.1V upon lapse of duration t2, the LED on the input side of the photo transistor coupler 36 starts to emit light, whereby the output side of the photo transistor coupler 36 is electrically communicated. As a result of the electrical communication, the gate voltage Vg(21) of the MOSFET 21 exceeds the threshold value Vth(21) of the MOSFET 21, with the result that current is allowed to flow between the drain and the source of the MOSFET 21, and the voltage V(15*a*) detected at the opposite ends of the power application coil 13*a* is raised. As a result, current starts to flow through the power application coil 13*a*. When the input voltage V exceeds a predetermined value after current flows through the power application coil 13*a*, then, the output side of the electromagnetic switching device is rendered electrically communicated (at time T2). Since the Zener diode 25 is connected with the gate of the MOSFET 21 by way of the capacitor 24 and the resistor 34, the maximal value of the gate voltage Vg(21) of the MOSFET 21 is regulated not to exceed the zener voltage Vzd(25) of the Zener diode 25.

Then, the gate voltage Vg(21) of the MOSFET 21 is gradually lowered depending on a predetermined time constant defined by the resistor 23, the capacitor 24, the Zener diode 25, and the like. When the gate voltage Vg(21) of the MOSFET 21 is lowered than the threshold value Vth(21) of the MOSFET 21 upon lapse of the duration t3, power application is cut off between the drain and the source of the MOSFET 21, whereby current flow in the power application coil 13*a* is suspended (at time T3). In this embodiment, the circuit constant with respect to the resistor 23, the capacitor 24, and the like is set such that the duration t3 is, e.g., about 100 ms.

After confirming that the output side of the electromagnetic switching device (sealed contact device) is rendered electrically communicated for the duration t4 in a state that current is allowed to flow merely through the power retaining coil 13*b*, application of input voltage V is suspended. Then, the gate voltage of the MOSFET 22 is lowered. When the gate voltage is lowered than the threshold value Vth(22) of the MOSFET 22, power application is cut off between the drain and the source of the MOSFET 22. Thereby, current flow through the power retaining coil 13*b* is suspended, and the output side of the electromagnetic switching device is electrically discommunicated to thereby cut off power application thereat (at time T5).

In the above configuration, since the output side of the electromagnetic switching device has its electrical communicable state secured by allowing current to flow merely through the power retaining coil 13*b*, power consumption required for input operation is suppressed at a relatively low level.

The circuit in this embodiment is configured such that current is allowed to keep flowing through the power retaining coil 13*b* for a certain duration before the power application coil 13*a* is energized and that current is allowed to keep flowing through the power retaining coil 13*b* for a certain duration after the power application coil 13*a* is de-energized. This arrangement makes it possible to suppress generation of counterelectromotive force at the opposite ends of the power application coil 13*a*.

The above arrangement makes it possible to prevent current from flowing through the power application coil 13*a* even if noise is applied between the input terminals 20*a*, 20*b* (sic) by providing the photo transistor coupler 36 as an example of so-called voltage-reactive-electronic switches, which is operative to activate when the input voltage V exceeds a predetermined value. This arrangement obviates a likelihood that the temperature of the power application coil 13*a* is unexpectedly raised due to continuous power application to the power application coil 13*a*, while stabilizing the operation of rendering the output side of the electromagnetic switching device electrically communicable. Further, since the photo transistor coupler 36 as an example of the voltage-reactive-electronic switches energizes the power application coil 13*a* when the input voltage V exceeds a predetermined value, the output side of the device can be securely rendered electrically communicable even if the input voltage V is applied in a relatively moderately rising manner.

Further, the circuit is configured such that the gate voltage Vg(21) of the MOSFET 21 is gradually lowered depending on the predetermined time constant defined by the resistor 23, the capacitor 24, the Zener diode 25, and the like. With this arrangement, since the MOSFET (first switch) 21 connected with the power application coil 13*a* is gradually turned off, remarkably suppressed is likelihood that counterelectromotive force may be generated at the time of turning off the power application coil 13*a* as compared with the case where a mechanical switch is used.

Furthermore, the circuit is incorporated with the diode 39 serially connected with the power application coil (first coil) 13*a*, and the cathode of the diode 39 is connected with the power application coil 13*a*. This arrangement makes it possible to block current from flowing to the control circuit 20 when the input voltage is applied in such a manner as to set the anode of the diode 39, namely, input terminal 20*a* (sic), at electronegative potential, thereby keeping the power application coil 13*a* from energizing. Since the electromagnetic switching device is not activated in this case, this arrangement makes it possible to easily judge that polarity of the input voltage to be applied between the input terminals 20*a*, 20*b* (sic) is improper.

Furthermore, since the resistor 23 and the diode 33 are connected in parallel to each other between the gate and the source of the MOSFET 21, charges of the capacitor 24 can be quickly discharged when application of the input voltage V is suspended. With this arrangement, even if application and suspending application of input voltage V are repeated at a short interval, the output side of the electromagnetic switching device can be securely rendered electrically communicable and discommunicable in response to application and suspending application of input voltage V.

Alternatively, employing either one of the circuits 20*a* to 20*d*, which have been respectively described in the third to sixth embodiments, in the electromagnetic switching device of the first or second embodiment including a sealed contact device may accomplish further energy saving by using the first coil 13*a* and the second coil 13*b* in place of the coil 13 used in the first or second device and by controlling timing of energizing and de-energizing the first and second coils 13 (sic) as mentioned above.

Next, described is a mechanism of connecting the control circuit block with the electromagnetic switching devices shown in the first through sixth embodiments including a sealed contact device with a simplified construction so as to lessen the power consumption by the coil 13.

(Seventh Embodiment)

Figure 14:
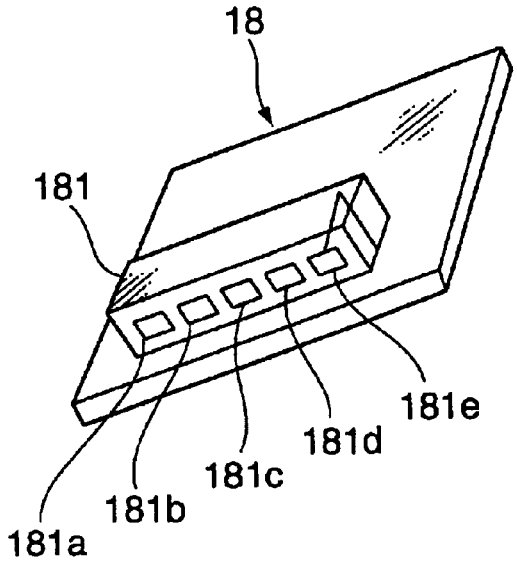
FIG. 14 is a perspective view of a control circuit block.
Figure 15:
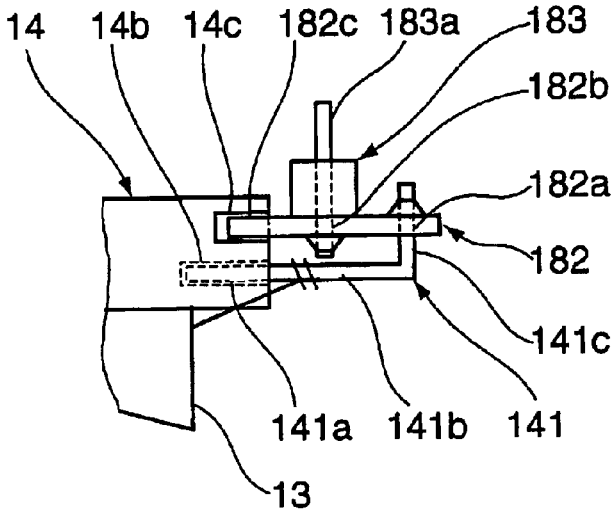
FIG. 15 is a cross-sectional view showing essential parts of an electromagnetic switching device as a seventh embodiment of this invention for electrically connecting a coil with a control circuit block.
Figure 16:
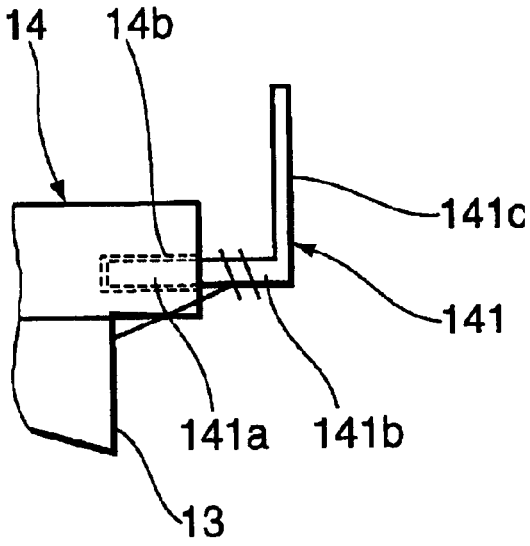
FIG. 16 is a cross-sectional view showing essential parts of an altered arrangement of the seventh electromagnetic switching device for electrically connecting a coil with a control circuit block.
Figure 17:
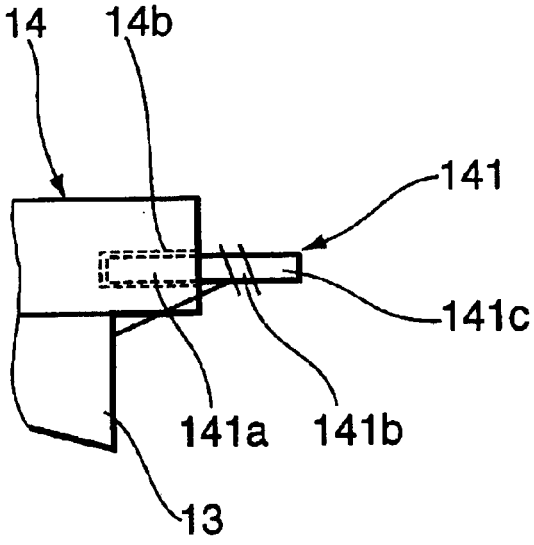
FIG. 17 is a cross-sectional view showing essential parts of another altered arrangement of the seventh electromagnetic switching device for electrically connecting a coil with a control circuit block.

FIG. 14 is a perspective view of the control circuit block. FIG. 15 is sectional view showing essential parts of electrically connecting the coil and the control circuit block in the seventh embodiment. FIGS. 16 and 17 are sectional views showing essential parts of electrically connecting the coil and the control circuit block 18 as alterations of the seventh embodiment, respectively.

As shown in FIG. 14, a connector 181 is mounted on the control circuit block 18, and the connector 181 is provided with five contacts 181*a* through 181*e* which are electrically connected with a control circuit (not shown). The connector 181 is so constructed as to be electrically connectable with a substrate contact 183*a* (see FIG. 15) or a coil terminal 141

(see FIGS. 16 and 17), which will be described later. The control circuit block 18 is fixed to the housing C by way of a potting agent 18A (see FIG. 6) such that the control circuit block 18 is supported on the housing C with certain elasticity or resiliency. The potting agent 18A is e.g. composed of polyurethane resin, and serves to block moisture component from intruding into the control circuit and to dissipate heat generated in the control circuit by covering the control circuit of the control circuit block 18 with the potting agent A.

Now, the arrangement as to how the coil 13 and the control circuit block 18 are rendered electrically communicable with each other (see FIG. 14) is described referring to FIG. 15.

The coil terminal 141 and a wiring substrate 182 are fixedly attached to a coil bobbin 14 around which the coil 13 is wound. A substrate connector 183 is fixedly attached to the wiring substrate 182.

Specifically, the coil terminal 141 is made of a conducting material and is configured into a substantially L-shape. The coil terminal 141 is fixed to the coil bobbin 14 by passing a proximal end 141*a* of the coil terminal 141 in an insertion hole 14*b* formed in the coil bobbin 14 or by simultaneous formation. An end of the coil 13 is wound around an intermediate part 141*b* of the coil terminal 141 protruding from the coil bobbin 14 radially outwardly from the coil 13 for electrical connection. A distal end 141*c* of the coil terminal 141 which is bent at about 90° with respect to a direction generally parallel to the central axis of the coil 13 is passed through an insertion hole 182*a* formed in the wiring substrate 182, which will be described later. The coil terminal 141 is electrically connected with a wiring pattern (not shown) on the wiring substrate 182 by soldering or its equivalent.

The wiring substrate 182 is formed with the insertion hole 182*a* for receiving the distal end 141*c* of the coil terminal 141, an insertion hole 182*b* for receiving a substrate contact 183*a* provided on a substrate connector 183, which will be described later, and a wiring pattern (not shown) for electrically communicating the insertion hole 182*a* and the insertion hole 182*b*. The wiring substrate 182 has one end 182*c* thereof fixedly supported on the coil bobbin 14 by passing the one end 182*c* in an insertion groove 14*c* formed in the coil bobbin 14.

The substrate contact 183*a* formed on the substrate connector 183 is made of a conducting material. The wiring substrate 182 is rendered electrically communicable with the connector 181 by passing one end of the substrate contact 183*a* through the insertion hole 182*b* of the wiring substrate 182 while electrically connecting the substrate contact 183*a* with the wiring pattern (not shown) formed on the wiring substrate 182 by soldering or its equivalent, and by electrically connecting the other end of the substrate contact 183*a* with a corresponding one of the contacts 181*a* through 181*e* of the connector 181.

In this way, the coil 13 is electrically connected with the control circuit of the control circuit block 18 by way of the coil terminal 141, the wiring pattern on the wiring substrate 182, the substrate contacts 183*a*, and the connector 181.

In the above construction, since positional relation between the connector 181 and the substrate connector 183 in connecting the two elements relative to each other is optimally adjusted by the coil terminal 141, the wiring substrate 182 and the other relevant parts, electrical connection between the coil 13 and the control circuit is optimally secured even if the device encounters difficulty in attaining electrical connection such as a case that the coil bobbin 14 is disposed remotely away from the control circuit bock 18. Furthermore, since the device is so constructed as to electrically connect the coil 13 with the control circuit of the control circuit block 18 by allowing each substrate contact 183*a* to pass through a corresponding one of the contacts 181*a* through 181*e*, even if the device is subjected to vibration resulting from opening and closing of the contacts or the like, the arrangement suppresses occurrence of electrical disconnection. Thus, electrical contact reliability is improved aided by the arrangement that the control circuit block 18 is supported on the housing C with a certain resiliency or elasticity by applying the potting agent 18A (see FIG. 6) to the control circuit bock.

The arrangement of electrically connecting the coil 13 and the control circuit block 18 (see FIG. 14) may be changed or altered optionally. For instance, arrangements shown in FIGS. 16 and 17 are proposed.

The arrangement shown in FIG. 16 has a feature that a coil terminal 141 is directly and electrically connectable with a corresponding one of contacts 181*a* through 181*e* of a connector 181 without providing a wiring substrate 182 and a substrate connector 183 (see FIG. 15 for both of the elements).

Specifically, the coil terminal 141 is made of a conducting material, and is configured into a generally L-shape. The coil terminal 141 is directly and electrically connectable with a corresponding one of the contacts 181*a* through 181*e* of the connector 181 by passing a proximal end 141*a* of the coil terminal 141 in an insertion hole 14*b* formed in a coil bobbin 14 for fixation while winding one end of a coil 13 around an intermediate part 141*b* protruding from the coil bobbin 14 radially outwardly from the coil 13 for electrical connection, and by passing a distal end 141*c* of the coil terminal 141 bent at about 90° with respect to a direction generally parallel to the central axis of the coil 13 into a corresponding one of the contacts 181*a* through 181*e* of the connector 181.

The above arrangement makes it possible to electrically connect the coil 13 with the control circuit of the control circuit block 18 without providing a wiring substrate 182 and a substrate connector 183. Accordingly, this arrangement can reduce the number of parts of the device in electrically connecting the coil with the control circuit of the control circuit block, and provides the sealed contact device at a low cost.

The arrangement shown in FIG. 17 has a feature that a coil terminal 141 is directly and electrically connected with a corresponding one of contacts 181*a* through 181*e* of a connector 181 without providing a wiring substrate 182 and a substrate connector 183 (see FIG. 15 for both of the elements).

Specifically, the coil terminal 141 is made of a conducting material. The coil terminal 141 is directly and electrically connected with a corresponding one of the contacts 181*a* through 181*e* of the connector 181 by passing a proximal end 141*a* of the coil terminal 141 in an insertion hole 14*b* formed in a coil bobbin 14 while winding one end of a coil 13 around an intermediate part 141*b* of the coil terminal 141 protruding from the coil bobbin 14 radially outwardly from the coil 13, and by passing a distal end 141*c* formed continuously and integrally with the intermediate part 141*b* into a corresponding one of the contacts 181*a* through 181*e* of the connector 181.

The above arrangement makes it possible to electrically connect the coil terminal 141 with a corresponding one of the contacts 181*a* through 181*e* of the connector 181 without providing a wiring substrate 182 and a substrate connector 183. Accordingly, this arrangement can reduce the number of parts of the device in electrically connecting the coil with the control circuit of the control circuit block. Further, since the shape of the coil terminal 141 is simple, the device can be produced easily, which makes it possible to produce the device at a low cost.

In the seventh embodiment, the coil terminal 141 and the substrate connector 183 serving as a male connector are provided on the side of the connecting section where the coil bobbin 14 is provided, while the connector 181 serving as a female connector is provided on the side of the connecting section where the control circuit block 18 is provided. Alternatively and conversely, a female connector may be provided on the side of the connecting section where the coil bobbin 14 is provided, while a male connector may be provided on the side of the connecting section where the control circuit block 18 is provided. It is needless to say that such an altered arrangement does not impair the operations and effects of this invention.

Next, a further embodiment of this invention is described.

(Eighth Embodiment)

The eighth embodiment is directed to a mechanism as to how the coil block in the first through sixth electromagnetic switching devices including a sealed contact device is connected with the control circuit block with a simplified construction.

Figure 18:
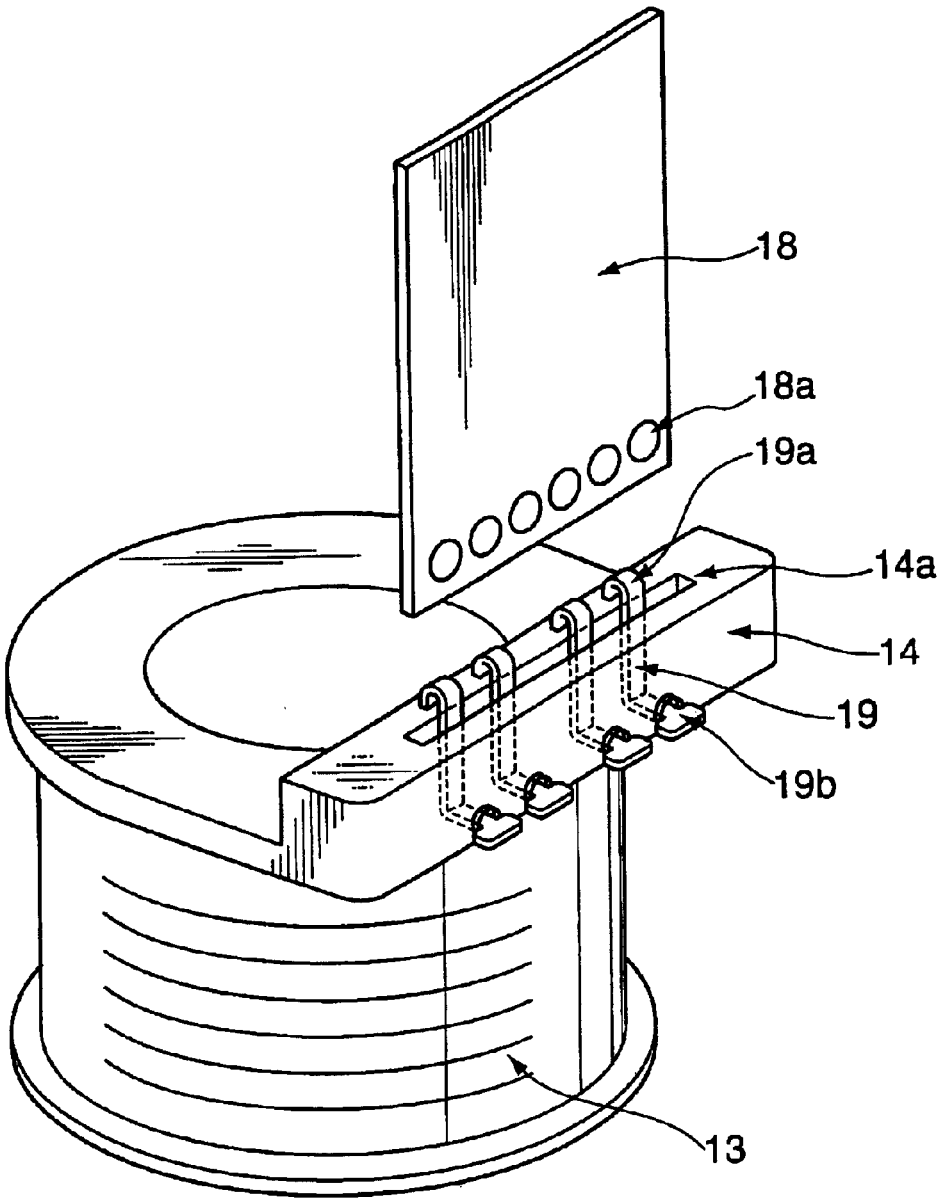
FIG. 18 is a perspective view showing an arrangement of an electromagnetic switching device as an eighth embodiment of this invention for electrically connecting a coil block with a control circuit block.

FIG. 18 is a perspective view showing an arrangement that the coil block and the control circuit block are electrically connected with each other in the eighth embodiment of this invention.

The coil block and the control circuit block are usable, for instance, with the electromagnetic switching device 501 (see FIG. 5) including a sealed contact device.

The coil block is so configured as to suppress power consumption by a coil at a relatively low level. The coil block comprises a coil 13 including a power application coil (first coil) 13*a* and a power retaining coil (second coil) 13*b* (see FIG. 7), a coil bobbin 14, and a plurality of conducting members 19 each in generally L-shape. A control circuit (not shown) is formed on the control circuit block 18 to control energizing and de-energizing of the coil 13. Plural electrodes 18*a* are arranged on the control circuit block 18 to be electrically connectable with the respective corresponding conducting members 19.

The coil 13 is wound around the coil bobbin 14. The coil bobbin 14 is formed with a slit 14*a* in an upper part thereof for mounting the control circuit block 18 therein. The conducting members 19 are adapted to electrically connect the coil 13 with the control circuit block 18. One end (resilient portion) 19*a* of each conducting member 19 has a substantially J-shape with a certain resilient deformability. The resilient portion 19*a* of the conducting member 19 is electrically connected with a corresponding one of the electrodes 18*a* provided on the control circuit block 18, while the other end 19*b* thereof is electrically connected with the coil 13.

In the above arrangement, in the case where the control circuit block 18 is mounted on the coil bobbin 14 through the slit 14*a* formed in the coil bobbin 14, the resilient portions 19*a* of the conducting members 19 are pressed against the respective corresponding electrodes 18*a* of the control circuit block 18, thereby securing electrical connection between the conducting members 19 and the respective corresponding electrodes 18*a*. It is needless to say that the electrical connection is further secured by soldering the contact portions between the conducting members 19 and the electrodes 18*a*.

Next, still another embodiment of this invention is described.

(Ninth Embodiment)

The ninth embodiment is directed to another mechanism as to how the coil block in the first through sixth electromagnetic switching devices including a sealed contact device is connected with the control circuit block with a simplified construction.

Figure 19:
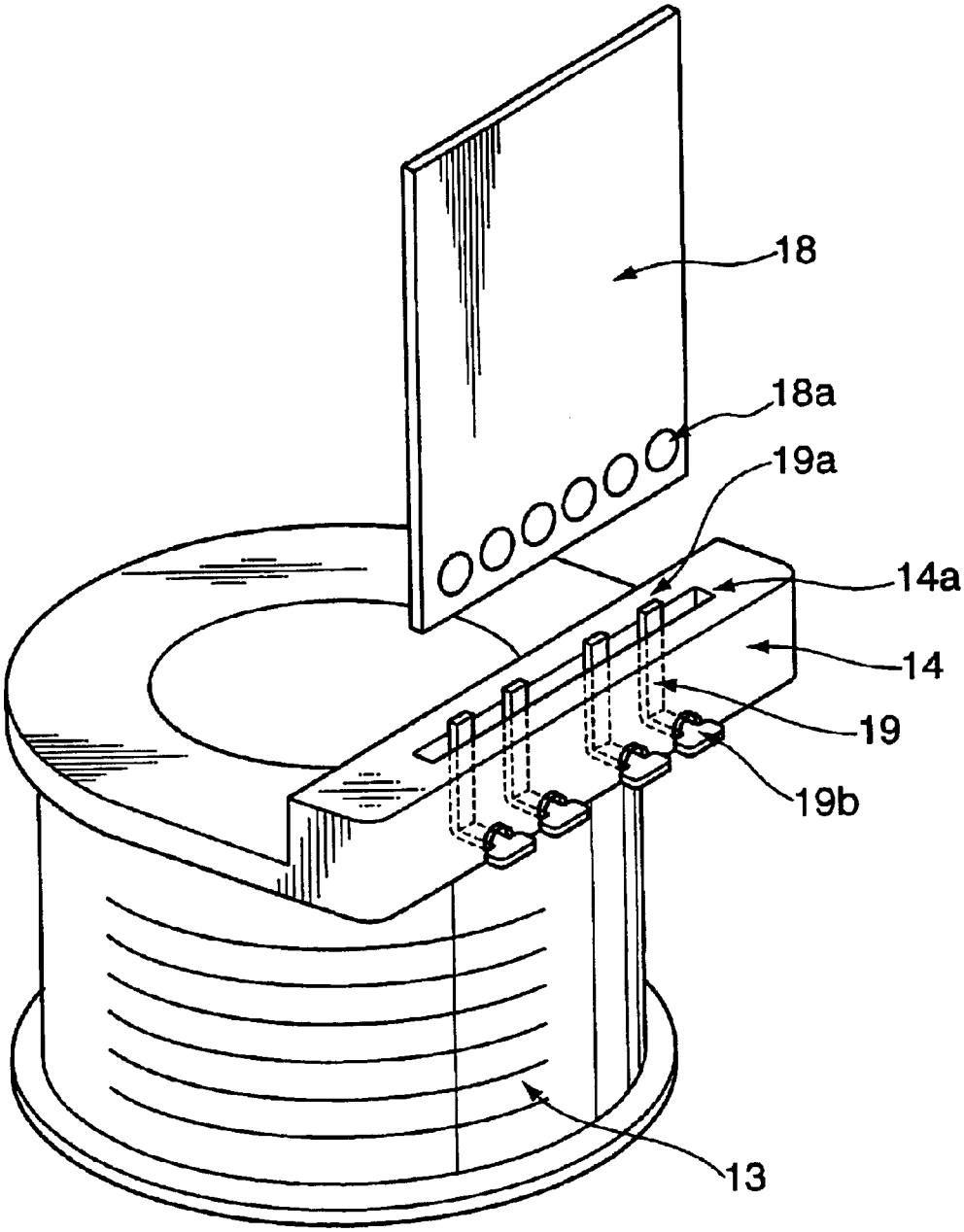
FIG. 19 is a perspective view showing an arrangement of an electromagnetic switching device as a ninth embodiment of this invention for electrically connecting a coil block with a control circuit block.

FIG. 19 is a perspective view showing an arrangement as to how the coil block and the control circuit block are electrically connected with each other in the ninth embodiment of this invention.

Referring to FIG. 19, the coil block in the ninth embodiment is different from that in the eighth embodiment in the structure of the one end 19*a* of the conducting member 19. Specifically, the one end 19*a* of the conducting member 19 in this embodiment has a generally linear shape, in place of the generally J-shaped one end 19*a* having a certain resilient deformability in the eighth embodiment.

In the above arrangement, in the case where the control circuit block 18 is mounted on a coil bobbin 14 through a slit 14*a* formed in the coil bobbin 14, the one end 19*a* of the conducting member 19 contacts a corresponding one of electrodes 18*a* of the control circuit block 18, and the conducting members 19 are electrically connected with the control circuit block 18 at the contact portions between the one ends 19*a* and the respective corresponding electrodes 18*a*. The electric connection is further secured by connecting the contacts portions by soldering or its equivalent, as with the case of the first embodiment (sic).

In the above arrangement, since the conducting member 19 has a relatively simple shape, the conducting members 19 can be produced relatively simply. As a result, the coil block can also be produced relatively simply, and accordingly, the electromagnetic switching device incorporated with the coil block can be produced relatively simply.

Next, still another embodiment of this invention is described.

(Tenth Embodiment)

The tenth embodiment is directed to still another mechanism as to how the coil block in the first through sixth electromagnetic switching device including a sealed contact device is connected with the control circuit block with a simplified construction.

Figure 20:
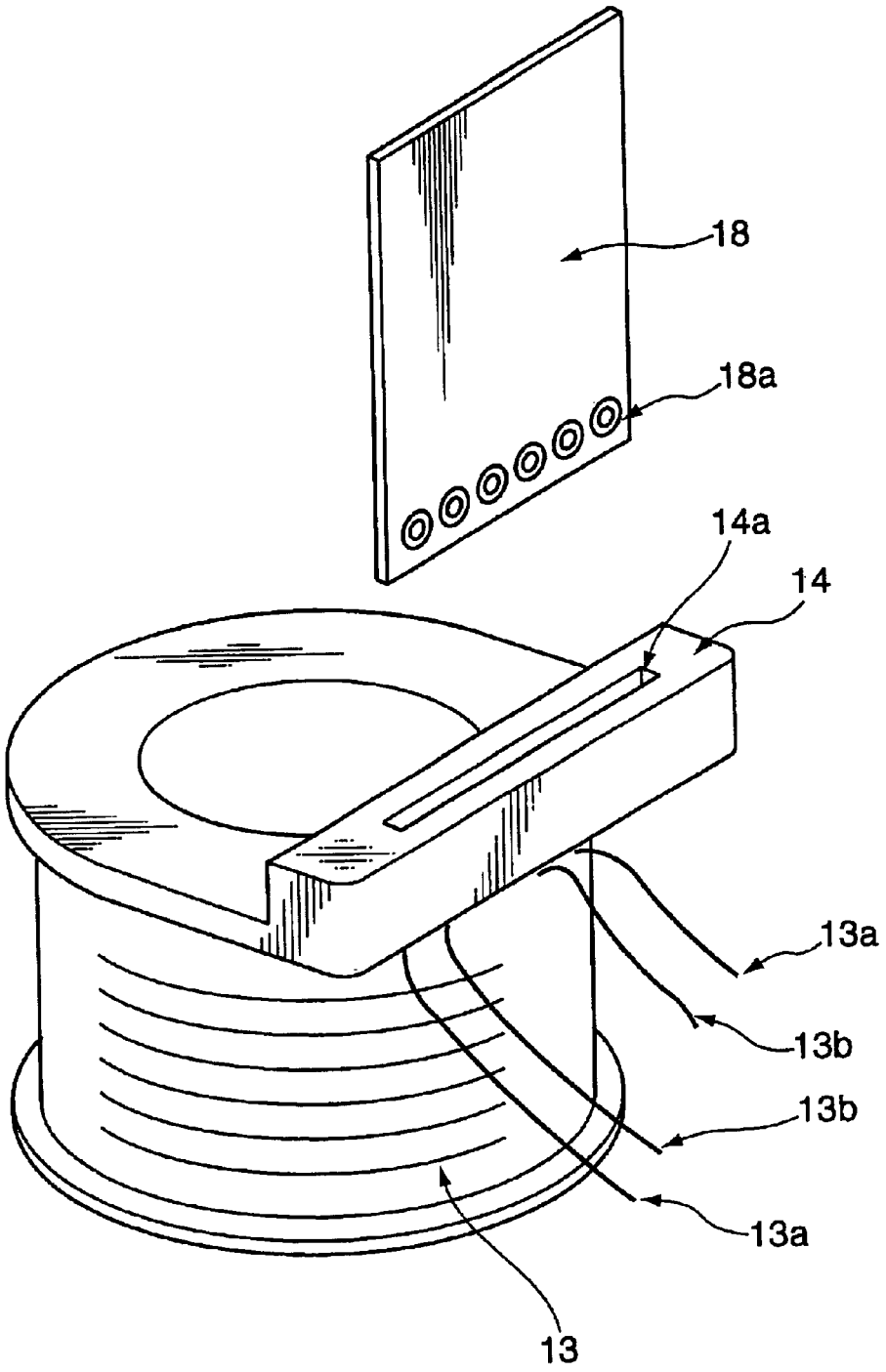
FIG. 20 is a perspective view showing an arrangement of an electromagnetic switching device as a tenth embodiment of this invention for electrically connecting a coil block with a control circuit block.

FIG. 20 is a perspective view showing an arrangement as to how the coil block and the control circuit block are electrically connected with each other in the tenth embodiment of this invention.

Referring to FIG. 20, the arrangement of the tenth embodiment is different from that of the eighth and ninth embodiments in that the coil block is not provided with conducting members 19 (see FIGS. 18 and 19) and that the control circuit block 18 is provided with plural electrodes 18*a* each in the form of recess with its periphery made of a conducting material in the tenth embodiment.

In the above arrangement, the electrodes 18*a* formed in the control circuit block 18, and opposite ends of a power application coil 13*a* and the opposite ends of a power retaining coil 13*b* are electrically connected with each other by soldering or its equivalent. The control circuit block 18 is mounted on a coil bobbin 14 through a slit formed in the coil bobbin 14.

In this embodiment, since the coil block is not provided with conducting members 19 (see FIGS. 18 and 19), the number of parts of the connecting section can be reduced. Thus, the electromagnetic switching device incorporate with the connecting section can be produced at a relatively low cost.

According to the seventh through tenth embodiments of this invention, the control circuit block 18 is easily mounted on the coil bobbin 14 in assembling the electromagnetic switching device. Thus, assembling of the device is facilitated. Further, the control circuit blocks 18 and the coil bobbins 14 can be stored and transported individually before assembling, which leads to improvement in utility.

What is primarily disclosed in the present specification is summarized as follows:

(Item 1)

An electromagnetic switching device comprising:

a sealed contact section including:

a sealing vessel made of an insulating material;

a fixed terminal provided with a fixed contact, the fixed terminal being air-tightly jointed to the sealing vessel;

a movable contact piece provided with a movable contact which is rendered movable toward and away from the fixed contact;

a cylindrical part with a closed bottom and made of a magnetic material for housing a movable iron core which moves the movable contact toward and away from the fixed contact;

a first joint member made of a metallic material with an insertion hole formed substantially in a center thereof, a metal plate made of a non-magnetic material with a hole formed substantially in a center thereof, the hole having an inner diameter substantially the same as an inner diameter of the cylindrical part;

a second joint member made of a metallic material, the second joint member being fixedly and air-tightly jointed to the sealing vessel and the first joint member;

a movable shaft having one end thereof fixedly attached to the movable iron core, the movable shaft being axially movable in the insertion hole of the first joint member;

a compression spring for urging the movable contact piece in such a direction as to urge the movable contact toward the fixed contact;

a retainer for retaining the compression spring in a compressed and suspended state in such a manner that the movable contact piece is operatively linked to the movable shaft; and a return spring for urging the movable iron core in such a direct as to move the movable contact away from the fixed contact; and a driving section for driving the movable iron core, wherein the cylindrical part and the first joint member are air-tightly jointed each other with the metal plate provided therebetween, and the movable iron core is housed in the cylindrical part with a clearance defined by the movable iron core and the first joint member corresponding to a required stroke within which the movable contact is rendered movable toward and away from the fixed contact.

The above electromagnetic switching device including a sealed contact device is advantageous in reducing the number of parts of the device while improving magnetic efficiency of the electromagnet of the device. Further, since magnetic attracting performance of the electromagnet is improved, spring load can be raised, and accordingly, switching performance of the sealed contact device can be improved. If the same spring load as set for the conventional device is set in the inventive device, the electromagnet of a small size can be used, which contributes to production of the inventive electromagnetic switching device including a sealed contact device of a small size.

(Item 2)

The electromagnetic switching device according to Item 1, wherein the cylindrical part has a flange portion at an open one end thereof, and the metal plate has a joint portion to be jointed to the flange portion of the cylindrical part, and a flange portion to be jointed to the first joint member, the metal plate having a thickness substantially identical to the stroke defined by the movable iron core and the first joint member.

The above electromagnetic switching device including a sealed contact device is advantageous in facilitating jointing the cylindrical part and the metal plate, and the metal plate and the first joint member.

(Item 3)

The electromagnetic switching device according to Item 1, wherein the cylindrical part is formed with a flange portion at an open one end thereof, and the metal plate has such a thickness as to joint the metal plate to the flange portion of the cylindrical part and to the first joint member simultaneously by welding.

The above electromagnetic switching device including a sealed contact device is advantageous in reducing the number of parts of the device while securing magnetic attracting force at a terminal stage of energizing substantially at the same level as the conventional device, although magnetic attracting force at an initial stage of energizing is not so large. Further, since the metal plate has a simple shape, and the cylindrical part, the metal plate, and the first joint member can be jointed each other simultaneously, the number of processes of assembling the device can be lessened.

(Item 4)

An electromagnetic switching device constructed such that movable and fixed contacts are rendered movable toward and away from each other by an electromagnet which is energized and de-energized in response to an input signal, the device comprising a coil constituting the electromagnet, the coil including a first coil member which is energized at least at a time when the movable contact contacts the fixed contact, and a second coil member which is energized at least while the movable contact is in a contact state with the fixed contact.

(Item 5)

The electromagnetic switching device according to any one of Items 1 through 3, wherein the driving section includes a yoke and a coil for magnetically attracting the movable iron core for driving, the coil constitutes an electromagnet which is energized and de-energized in response to input of an operative signal to the device, the coil including a first coil member which is energized at least at a time when the movable contact contacts the fixed contact, and a second coil member which is energized at least while the movable contact is in a contact state with the fixed contact.

The electromagnetic switching device as set forth in Item 4 or Item 5 is advantageous in suppressing power consumption required on the input side of the device in driving the device at a relatively low level since the coil includes the first coil member and the second coil member.

(Item 6)

The electromagnetic switching device according to Item 4 or 5, wherein the first coil member and the second coil member are connected in parallel to each other or in series, the device further comprising a first switch for operatively allowing power to be applied to the first coil member for a predetermined duration in response to the input signal.

(Item 7)

The electromagnetic switching device according to any one of Items 4 to 6, further comprising a second switch for operatively allowing power to be applied to the second coil member.

The electromagnetic switching device as set forth in Item 6 or Item 7 is advantageous in preventing the coil from burning out or being damaged resulting from unexpected temperature rise of the coil.

(Item 8)

The electromagnetic switching device according to Item 4 or 5, wherein the first coil member and the second coil member are connected in parallel to each other or in series, the device further comprising a first switch for operatively allowing power to be applied to the first coil member for a predetermined duration in response to the input signal, and a second switch for operatively allowing power to be applied to the second coil member, wherein the first switch is turned on after the second switch is turned on upon application of the input signal, and is turned off upon lapse of a predetermined duration after the movable contact contacts the fixed contact.

The above electromagnetic switching device can suppress generation of noise emitted from the coil almost at zero level.

(Item 9)

The electromagnetic switching device according to Item 7 or 8, wherein the second switch is so configured as to be controlled based on a signal from an external device.

The above electromagnetic switching device provides more stable power retaining state.

(Item 10)

The electromagnetic switching device according to any one of Items 6 through 9, wherein the first switch includes a MOSFET.

The electromagnetic switching device is advantageous in preventing the coil from burning out or being damaged resulting from unexpected temperature rise of the coil.

(Item 11)

The electromagnetic switching device according to any one of Items 7 through 10, wherein the second switch includes a MOSFET. The thus constructed device is advantageous in suppressing counterelectromotive force from generating at the time of turning off the second coil.

(Item 12)

The electromagnetic switching device according to Item 10 or 11, wherein a resistor, and a circuit in which a capacitor and a zener diode are serially connected each other are connected in parallel to each other between a gate and a source of the MOSFET of the first switch, the input signal being applied to a connecting point between the capacitor and the zener diode.

The above electromagnetic switching device is advantageous in suppressing power consumption required on the input side of the device in driving the device at a relatively low level.

(Item 13)

The electromagnetic switching device according to any one of Items 10 through 12, further comprising a diode to be serially connected with the first coil member, wherein the diode has a cathode to be connected with a drain of the MOSFET of the first switch.

(Item 14)

The electromagnetic switching device according to any one of Items 10 through 12, further comprising a diode to be serially connected with the first coil member, wherein the diode has a cathode to be connected with the first coil member.

In the electromagnetic switching device according to Item 13 or Item 14, since current it prohibited from flowing through the control circuit in the case where such an input signal as to set the anode of the diode at negative potential is applied to the device, the power application coil is controlled not to energize. In this case, since the device is not activated, this arrangement makes it easy to judge that polarity of the input voltage to be applied between the input terminals of the device is improper.

(Item 15)

The electromagnetic switching device according to Item 8, further comprising a third switch for operatively activating the first switch if the input signal exceeds a predetermined value.

In the above electromagnetic switching device, since current is prohibited from flowing through the power application coil even if noise is applied between the input terminals of the device, this arrangement enables to stabilize the electrical communication on the output side of the device.

(Item 16)

The electromagnetic switching device according to Item 15, wherein the third switch includes a phototransistor or a MOSFET.

The above electromagnetic switching device is advantageous in further stabilizing the electrical communication on the output side of the device.

(Item 17)

The electromagnetic switching device according to Item 15 or 16, wherein a resistor, and a diode having a cathode to be connected with a gate of the MOSFET of the first switch and an anode to be connected with a source of the MOSFET of the first switch are connected in parallel to each other between the gate and the source of the MOSFET of the first switch.

The above electromagnetic switching device is advantageous in securely rendering the device electrically communicable even if input voltage is applied to the device at a relatively short time interval.

(Item 18)

The electromagnetic switching device according to any one of Items 4 through 17, wherein the first coil member is wound at a radially outward portion of the electromagnet, and the second coil member is wound at a radially inward portion of the electromagnet, and power is applied to the first coil member the second coil member in such a manner that magnetic fluxes generated along central axes of the first coil member and the second coil member are directed substantially in identical directions to each other.

The above electromagnetic switching device is advantageous in effectively utilizing magnetomotive force generated at the time of energizing the coil, and in suppressing counterelectromotive force generated at the time of de-energizing the coil at a relatively low level.

(Item 19)

The electromagnetic switching device according to any one of Items 1 through 18, further comprising a control circuit block on which a control circuit is formed to control energizing and de-energizing of an electromagnet, and means for electrically connecting the control circuit with the coil.

The above electromagnetic switching force is advantageous in facilitating assembling of the device incorporated with the control circuit block.

(Item 20)

The electromagnetic switching device according to Item 19, further comprising a coil bobbin on which the coil is wound, the coil bobbin being formed with a slit for fixing the control circuit block.

The above electromagnetic switching force is advantageous in further facilitating assembling of the device incorporated with the control circuit block.

(Item 21)

The electromagnetic switching device according to Item 20, further comprising a conducting member having one end thereof electrically connected with an electrode formed on the control circuit block and the other end thereof electrically connected with the coil, the conducting member being supported on the coil bobbin through the slit formed in the coil bobbin.

The above electromagnetic switching force is advantageous in securing electrical connection between the coil and the electrode formed on the control circuit block.

(Item 22)

The electromagnetic switching device according to Item 21, wherein the one end of the conducting member includes a resilient portion integrally formed with the conducting member, and the conducting member is electrically connected with the electrode formed on the control circuit block by the resilient portion when the control circuit block is mounted on the coil bobbin through the slit formed in the coil bobbin.

The above electromagnetic switching force is advantageous in further securing electrical connection between the coil and the electrode formed on the control circuit block.

(Item 23)

The electromagnetic switching device according to Item 19, wherein the control circuit block includes a connector having a contact to be electrically connected with the control circuit, and a coil terminal is provided on the coil bobbin to be electrically connected with the coil and to be electrically connected with the contact of the connector, the coil terminal protruding from the coil bobbin, the coil being wound around the coil bobbin.

The above electromagnetic switching force is advantageous in facilitating assembling of the device incorporated with the control circuit block.

(Item 24)

The electromagnetic switching device according to Item 23, wherein the coil terminal has at least a distal end thereof directed in a direction substantially parallel to a central axis of the coil.

The above electromagnetic switching force is advantageous in further facilitating assembling of the device incorporated with the control circuit block.

(Item 25)

The electromagnetic switching device according to Item 23 or 24, further comprising a wiring substrate to be fixed to the coil bobbin, the wiring substrate including a predetermined wiring pattern thereon, and a substrate connector mounted on the wiring substrate, the substrate connector including a substrate contact to be electrically connected with the wiring pattern and to be electrically connectable with the contact of said connector, whereby the coil terminal and the wiring pattern are electrically connected each other.

The above electromagnetic switching device is advantageous in optimally carry out electrical connection between the coil and the control circuit even if the device encounters difficulty in electrical connection such as a case that the coil bobbin is disposed away from the control circuit block.

(Item 26)

The electromagnetic switching device according to Item 4, wherein the electromagnetic switching device is a sealed contact device comprising:

a sealing vessel made of an insulating material;

a fixed terminal provided with a fixed contact, the fixed terminal being air-tightly jointed to the sealing vessel;

a movable contact piece provided with a movable contact, the movable contact being movable toward and away from the fixed contact;

a movable iron core which is movable in a certain direction;

a cylindrical part with a closed bottom for housing the movable iron core therein a first joint member which is air-tightly jointed to the cylindrical part;

a second joint member for defining a hermetically sealed space by air-tightly jointing the second joint member, the sealing vessel, and the first joint member each other to accommodate the movable contact, the fixed contact, and the movable iron core therein, hydrogen gas or gas containing hydrogen as a primary ingredient being contained in the hermetically sealed space;

a movable shaft which is cooperatively linked to the movable iron core;

a compression spring for urging the movable contact piece in such a direction as to urge the movable contact toward the fixed contact;

a return spring for urging the movable iron core in such a direct as to render the movable iron core in a certain direction;

a unit of a yoke and a coil for magnetically attracting and driving the movable iron core; and a housing.

Since the above electromagnetic switching device is configured into a sealed contact device, the device is advantageous in suppressing power consumption required by the input side of the device at a relatively low level when the device is driven, and in suppressing noise emitted from the coil at substantially zero level.

This invention has been properly and sufficiently explained by way of the embodiments referring to the drawings to such an extent that a person skilled in the art may feasibly alter and/or modify the aforementioned embodiments. Therefore, unless otherwise such alteration or modification as to be implemented by a person skilled in the art depart from the scope of the invention defined in the appended claims, they should be construed as being included therein.

EXPLOITATION IN INDUSTRY

According to an aspect of this invention, provided is an electromagnetic switching device that attains improved energy saving as compared with a conventional electromagnetic switching device including a conventional sealed contact device. According to another aspect of this invention, provided is an electromagnetic switching device with less number of parts and with improved magnetic efficiency of an electromagnet of a driving section of the device. According to yet another aspect of this invention, provided is an electromagnetic switching device with less power consumption required by a coil, constituting an electromagnet, as compared with a case of conventional electromagnetic switching device including a conventional sealed contact device. According to still another aspect of this invention, provided is an electromagnetic switching device equipped with a mechanism that facilitates connecting the device with a control circuit block, with a simplified construction and at a low cost, in case that the device is incorporated with the control circuit block.

What is claimed is:

1. An electromagnetic switching device comprising:

a sealed contact section including:

a sealing vessel made of an insulating material;

a fixed terminal provided with a fixed contact, said fixed terminal being air-tightly jointed to said sealing vessel;

a movable contact piece provided with a movable contact which is rendered movable toward and away from said fixed contact;

a cylindrical part with a closed bottom and made of a magnetic material for housing a movable iron core which moves said movable contact toward and away from said fixed contact;

a first joint member made of a metallic material with an insertion hole formed substantially in a center thereof;

a metal plate made of a non-magnetic material with a hole formed substantially in a center thereof, the hole having an inner diameter substantially the same as an inner diameter of said cylindrical part;

a second joint member made of a metallic material, said second joint member being fixedly and air-tightly jointed to said sealing vessel and said first joint member;

a movable shaft having one end thereof fixedly attached to said movable iron core, said movable shaft being axially movable in the insertion hole of said first joint member;

a compression spring for urging said movable contact piece in such a direction as to urge said movable contact toward said fixed contact;

a retainer for retaining said compression spring in a compressed and suspended state in such a manner that said movable contact piece is operatively linked to said movable shaft; and a return spring for urging said movable iron core in such a direct as to move said movable contact away from said fixed contact; and a driving section for driving said movable iron core, wherein said cylindrical part and said first joint member are air-tightly jointed each other with said metal plate provided therebetween, and said movable iron core is housed in said cylindrical part with a clearance defined by said movable iron core and said first joint member corresponding to a required stroke within which said movable contact is rendered movable toward and away from said fixed contact.

2. The electromagnetic switching device according to claim 1, wherein said cylindrical part has a flange portion at an open one end thereof, and said metal plate has a joint portion to be jointed to the flange portion of said cylindrical part, and a flange portion to be jointed to said first joint member, said metal plate having a thickness substantially identical to the stroke defined by said movable iron core and said first joint member.

3. The electromagnetic switching device according to claim 1, wherein said cylindrical part is formed with a flange portion at an open one end thereof, and said metal plate has such a thickness as to joint the metal plate to the flange portion of said cylindrical part and to said first joint member simultaneously by welding.

4. The electromagnetic switching device according to claim 1, wherein said driving section includes a yoke and a coil for magnetically attracting and driving said movable iron core, the coil constitutes an electromagnet which is energized and de-energized in response to input of an operative signal to the device, said coil including a first coil member which is energized at least at a time when said movable contact contacts said fixed contact, and a second coil member which is energized at least while said movable contact is in a contact state with said fixed contact.

5. The electromagnetic switching device according to claim 1, further comprising a control circuit block on which a control circuit is formed to control energizing and de-energizing of an electromagnet, and means for electrically connecting said control circuit with said coil.

6. The electromagnetic switching device according to claim 1, further comprising a control circuit block on which a control circuit is formed to control energizing and de-energizing of an electromagnet, wherein a coil bobbin is formed with a slit through which said control circuit block is fixedly supported, said coil being wound around the coil bobbin.

7. The electromagnetic switching device according to claim 6, further comprising a conducting member having one end thereof electrically connected with an electrode formed on said control circuit block and the other end thereof electrically connected with said coil, said conducting member being supported on the coil bobbin through said slit formed in the coil bobbin.

8. The electromagnetic switching device according to claim 7, wherein said one end of said conducting member includes a resilient portion integrally formed with said conducting member, and said conducting member is electrically connected with the electrode formed on said control circuit block by the resilient portion when said control circuit block is mounted on the coil bobbin through said slit formed in the coil bobbin.

9. The electromagnetic switching device according to claim 5, wherein said control circuit block includes a connector having a contact to be electrically connected with said control circuit, and a coil terminal is provided on the coil bobbin to be electrically connected with said coil and to be electrically connected with said contact of said connector, said coil terminal protruding from the coil bobbin, said coil being wound around the coil bobbin.

10. The electromagnetic switching device according to claim 9, wherein said coil terminal has at least a distal end thereof directed in a direction substantially parallel to a central axis of said coil.

11. The electromagnetic switching device according to claim 9, further comprising a wiring substrate to be fixed to said coil bobbin, said wiring substrate including a predetermined wiring pattern thereon, and a substrate connector is mounted on said wiring substrate, said substrate connector including a substrate contact to be electrically connected with said wiring pattern and to be electrically connectable with said contact of said connector, whereby said coil terminal and said wiring pattern are electrically connected each other.

12. The electromagnetic switching device according to claim 4, wherein said first coil member and said second coil member are connected in parallel to each other or in series, the device further comprising a first switch for operatively allowing power to be applied to said first coil member for a predetermined duration in response to said input signal.

13. The electromagnetic switching device according to claim 4, further comprising a second switch for operatively allowing power to be applied to said second coil member.

14. The electromagnetic switching device according to claim 13, wherein said second switch is so configured as to be controlled based on a signal from an external device.

15. The electromagnetic switching device according to claim 12, wherein said first switch includes a MOSFET.

16. The electromagnetic switching device according to claim 12, wherein said second switch includes a MOSFET.

17. The electromagnetic switching device according to claim 15, wherein a resistor, and a circuit in which a capacitor and a zener diode are serially connected each other are connected in parallel to each other between a gate and a source of the MOSFET of said first switch, said input signal being applied to a connecting point between said capacitor and said zener diode.

18. The electromagnetic switching device according to claim 15, further comprising a diode to be serially connected with said first coil member, wherein the diode has a cathode to be connected with a drain of the MOSFET of said first switch.

19. The electromagnetic switching device according to claim 4, wherein said first coil member and said second coil member are connected in parallel to each other or in series, the device further comprising a first switch for operatively allowing power to be applied to said first coil member for a predetermined duration in response to said input signal, and a second switch for operatively allowing power to be applied to said second coil member, wherein said first switch is turned on after said second switch is turned on upon application of said input signal, and is turned off upon lapse of a predetermined duration after said movable contact contacts said fixed contact.

20. The electromagnetic switching device according to claim 19, further comprising a third switch for operatively activating said first switch if said input signal exceeds a predetermined value.

21. The electromagnetic switching device according to claim 20, wherein said third switch includes a phototransistor or a MOSFET.

22. The electromagnetic switching device according to claim 19, wherein a resistor, and a diode having a cathode to be connected with a gate of the MOSFET of said first switch and an anode to be connected with a source of the MOSFET of said first switch are connected in parallel to each other between the gate and the source of the MOSFET of said first switch.

23. The electromagnetic switching device according to claim 19, wherein said first coil member is wound at a radially outward portion of the electromagnet, and said second coil member is wound at a radially inward portion of the electromagnet, and power is applied to said first coil member and said second coil member in such a manner that magnetic fluxes generated along central axes of said first coil member and said second coil member are directed substantially in identical directions to each other.

* * * * *